US011270855B2

(12) United States Patent
Isoda et al.

(10) Patent No.: US 11,270,855 B2
(45) Date of Patent: Mar. 8, 2022

(54) MOVABLE CONTACT BODY FOR SWITCH, AND SWITCH

(71) Applicants: CITIZEN ELECTRONICS CO., LTD., Yamanashi (JP); CITIZEN WATCH CO., LTD., Tokyo (JP)

(72) Inventors: Hiroto Isoda, Yamanashi (JP); Satoshi Okuma, Yamanashi (JP); Soichiro Amano, Yamanashi (JP); Ken Ito, Yamanashi (JP)

(73) Assignees: CITIZEN ELECTRONICS CO., LTD., Yamanashi (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 16/765,435

(22) PCT Filed: Nov. 20, 2018

(86) PCT No.: PCT/JP2018/042902
§ 371 (c)(1),
(2) Date: May 19, 2020

(87) PCT Pub. No.: WO2019/098391
PCT Pub. Date: May 23, 2019

(65) Prior Publication Data

US 2020/0328041 A1 Oct. 15, 2020

(30) Foreign Application Priority Data

Nov. 20, 2017 (JP) ..... JP2017-222812

(51) Int. Cl.
*H01H 13/10* (2006.01)
*H01H 13/04* (2006.01)
(Continued)

(52) U.S. Cl.
CPC ..... *H01H 13/10* (2013.01); *H01H 13/04* (2013.01); *H01H 13/14* (2013.01); *H01H 13/52* (2013.01)

(58) Field of Classification Search
CPC ..... H01H 13/48; H01H 2203/038; H01H 2205/026; H01H 5/30; H01H 13/10;
(Continued)

(56) References Cited

U.S. PATENT DOCUMENTS 4,689,879 A * 9/1987 Fowler ..... H01H 13/702 156/87
5,357,065 A * 10/1994 Mitamura ..... H01H 13/7006 200/5 A
(Continued)

FOREIGN PATENT DOCUMENTS

CN 101086928 A 12/2007
CN 101901707 A 12/2010
(Continued)

OTHER PUBLICATIONS

International Search Report, Written Opinion and International Preliminary Report on Patentability for related International App. No. PCT/JP2018/042902 dated Feb. 12, 2019. English translation provided; 24 pages.
(Continued)

*Primary Examiner* — Ahmed M Saeed
(74) *Attorney, Agent, or Firm* — Procopio, Cory, Hargreaves & Savitch LLP

(57) ABSTRACT

The movable contact body for a switch includes at least one movable contact having an upwardly convex leaf-spring shape, a cover member disposed so as to cover an upper
(Continued)

surface of the movable contact, and a holding member disposed so as to face a lower surface of the movable contact, the holding member having a contact through-hole through which a top portion of the movable contact can pass.

11 Claims, 24 Drawing Sheets

(51) Int. Cl.
*H01H 13/14* (2006.01)
*H01H 13/52* (2006.01)

(58) Field of Classification Search
CPC ..... H01H 2215/012; H01H 13/14; H01H 2227/026; H01H 2229/028; H01H 13/023; H01H 19/11; H01H 2221/058; H01H 5/02; H01H 13/585; H01H 13/66; H01H 13/83; H01H 2217/004; H01H 2221/026; H01H 25/065; H01H 36/00; H01H 36/0006; H01H 36/0073; H01H 3/54; H01H 3/60; H01H 11/0006; H01H 13/52; H01H 19/115; H01H 2011/0043; H01H 2019/143; H01H 2217/01; H01H 2219/062; H01H 2221/06; H01H 2231/002; H01H 25/06; H01H 5/06; H01H 13/04; H01H 13/20
See application file for complete search history.

(56) References Cited

U.S. PATENT DOCUMENTS

| | | | | |
|---|---|---|---|---|
| 7,378,609 | B1 * | 5/2008 | Fedorjaka ..... | H01H 13/705 200/406 |
| 2007/0246335 | A1 * | 10/2007 | Sharrah ..... | H05B 39/041 200/1 B |
| 2012/0055773 | A1 | 3/2012 | Nakaoka et al. | |
| 2016/0071665 | A1 | 3/2016 | Watanabe et al. | |
| 2016/0104587 | A1 | 4/2016 | Oyamada et al. | |

FOREIGN PATENT DOCUMENTS

| | | | |
|---|---|---|---|
| CN | 102436953 | A | 5/2012 |
| CN | 103117183 | A | 5/2013 |
| CN | 203983099 | U | 12/2014 |
| CN | 105513867 | A | 4/2016 |
| CN | 106847591 | A | 6/2017 |
| JP | H1119131 | U | 8/1989 |
| JP | H11185565 | A | 7/1999 |
| JP | H11288641 | A | 10/1999 |
| JP | 3496393 | B | 2/2004 |
| JP | 2005338918 | A | 12/2005 |
| JP | 2010135151 | A | 6/2010 |
| WO | 2014175446 | A1 | 10/2014 |

OTHER PUBLICATIONS

Office Action dated Sep. 14, 2021 from counterpart CN Patent Application No. 201880074093.9, 15 pages.

* cited by examiner (a)

(b)

(c)

MOVABLE CONTACT BODY FOR SWITCH, AND SWITCH

This application is U.S. National Stage entry of PCT Application No. PCT/JP2018/042902, filed on Nov. 20, 2018, which claims priority to JP Application No. 2017-222812, filed Nov. 20, 2017. The contents of the foregoing are incorporated by reference.

FIELD

The disclosed embodiments relate to a movable contact body for a switch, and a switch including the movable contact body.

BACKGROUND

A movable contact body for a switch is known which is to be integrated with fixed contacts formed on a substrate to constitute a switch. For example. Patent Literature 1 describes a movable contact body for a switch, including a dome-shaped movable contact to be inverted by operation, a gluing tape fixing the movable contact from the upper side thereof, and an adhesive-backed protective film affixed so as to cover the lower side of the movable contact. The movable contact body described in Patent Literature 1 is transferred to a predetermined position by a transferring apparatus, such as a die bonder, with the adhesive-backed protective film being peeled off, and is then integrated with fixed contacts formed on a substrate, thereby constituting a switch. As for the movable contact body described in Patent Literature 1, affixing the adhesive-backed protective film so as to cover the lower side of the movable contact for storage and transfer allows for preventing foreign matter from adhering to the electric contact portions of the movable contact body.

CITATION LIST

Patent Literature

Patent Literature 1: Japanese Patent No. 3496393

SUMMARY

Unfortunately, since the movable contact of the movable contact body described in Patent Literature 1 is fixed only by the gluing tape, it may fall off by being shaken, for example, during transfer to a predetermined position by a transferring apparatus.

It is possible to temporarily dispose the switch below and to put a substrate thereon from above; however, in this case, the switch is hidden from view by the substrate, and thus cannot be affixed with high positional accuracy.

Since a conventional switch including an adhesive-backed film can hold only one spring functioning as a movable contact, the only possible way to ensure a favorable sense of click and durability is to enlarge the size of the spring; it is thus difficult to use such a conventional switch as a small one required to be durable, e.g., as a switch on a side surface of a smartphone.

Further, as for a conventional switch, solder reflow is required to connect a movable contact and a fixed contact by soldering; however, the solder reflow may vary the spring characteristics of the movable contact, resulting in variations in spring characteristics.

An object of a disclosed embodiment is to provide a small switch having improved durability at low cost.

Another object of a disclosed embodiment is to reduce the possibility of occurrence of a defect in the manufacturing steps due to falling of a movable contact, for example, during transfer to a predetermined position by a transferring apparatus, and to provide a movable contact body for a switch which can be mounted on a substrate with high positional accuracy, without solder reflow.

According to an embodiment, the movable contact body for a switch includes at least one movable contact having an upwardly convex leaf-spring shape, a cover member disposed so as to cover an upper surface of the movable contact, and a holding member disposed so as to face a lower surface of the movable contact, the holding member having a contact through-hole through which a top portion of the movable contact can pass.

According to an embodiment, the movable contact body preferably further includes a first adhesive sheet bonding the cover member and the holding member together.

According to an embodiment, the movable contact body preferably further includes a second adhesive sheet bonded to a surface of the holding member opposite to a surface thereof facing the first adhesive sheet.

According to an embodiment, the movable contact body preferably further includes a separator bonded to a surface of the second adhesive sheet opposite to a surface thereof facing the holding member.

According to an embodiment, the movable contact body preferably further includes a second adhesive sheet bonded to a surface of the holding member opposite to a surface thereof facing the cover member, and a substrate bonded to a surface of the second adhesive sheet opposite to a surface thereof facing the holding member, wherein the substrate preferably includes a base, first fixed contacts formed on the base, and second fixed contacts formed so as to surround the respective first fixed contacts, the movable contact body being disposed so as to be pushed down to electrically connect the first fixed contacts and the second fixed contacts.

According to an embodiment, the substrate of the movable contact body is preferably a flexible substrate.

According to an embodiment, the holding member of the movable contact body is preferably an electrically insulating member having another through-hole into which at least part of the movable contact can be inserted, the through-hole being disposed around the contact through-hole.

According to an embodiment, the movable contact body preferably further includes a fixing member having a hole for housing the movable contact to fix the movable contact, the fixing member being bonded to both the cover member and the holding member.

According to an embodiment, the holding member of the movable contact body preferably includes a first holding member and a second holding member which have the contact through-hole.

According to an embodiment, the holding member of the movable contact body is preferably an electrically conductive member at least part of which is in contact with the movable contact.

According to an embodiment, the switch includes a substrate, a first fixed contact formed on a substrate, a second fixed contact formed on the substrate so as to surround the first fixed contact, a movable contact body to be pushed down to electrically connect the first fixed contact and the second fixed contact, and an adhesive member bonding the substrate and the movable contact body together, wherein the movable contact body includes at least one movable contact having an upwardly convex leaf-spring shape and being in contact with the second fixed contact, a cover member disposed so as to cover an upper surface of the movable contact, and a holding member disposed so as to face a lower surface of the movable contact, the holding member having a contact through-hole through which a top portion of the movable contact can pass.

According to an embodiment, the holding member of the switch is preferably an electrically insulating member having another through-hole into which at least part of the movable contact can be inserted, the through-hole being disposed around the contact through-hole, and the second fixed contact preferably includes a second contact base and a second contact projection, the difference in height between the second contact base and the second contact projection being larger than the thickness of the holding member.

According to an embodiment, the holding member of the switch is preferably an electrically conductive member at least part of which is in contact with the movable contact to electrically connect the first fixed contact and the movable contact.

According to an embodiment, the substrate of the switch is preferably a flexible substrate.

As described above, the switches according to the embodiments can be reduced in size, and do not lose durability even if reduced in size.

The movable contact bodies according to the embodiments can be separated from the fixed contacts; it is thus possible to prevent occurrence of a defect in the manufacturing steps due to falling of the movable contact, for example, when the movable contact bodies are transferred to a predetermined position by a transferring apparatus.

BRIEF DESCRIPTION OF DRAWINGS

FIG. 22(*b*) is a plan view of the first movable contact shown in FIG. 21; FIG. 22(*c*) is a cross-sectional view of the first movable contact shown in FIG. 22(*b*), taken along line A-A'.

FIG. 24(*b*) is a perspective view of the flexible printed circuit board shown in FIG. 24(*a*).

DESCRIPTION OF EMBODIMENTS

Figure 1:
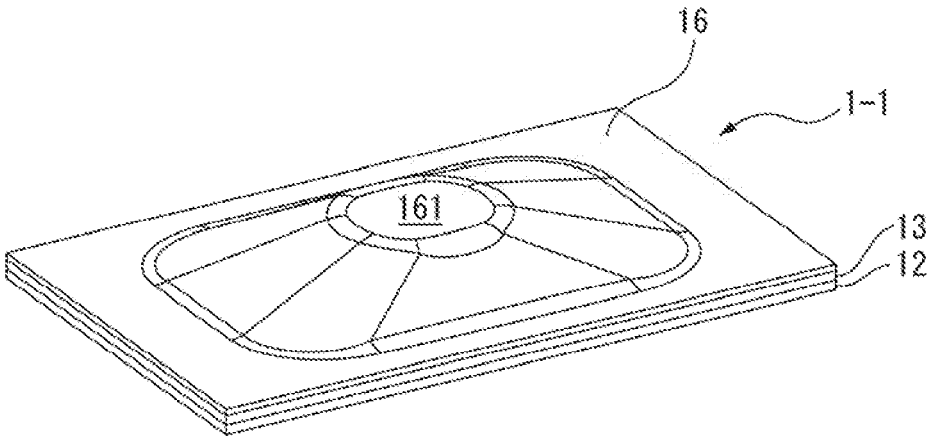
FIG. 1 is a perspective view of a movable contact body for a switch according to a first embodiment.

Hereinafter, with reference to the accompanying drawings, a movable contact body for a switch and a switch including the movable contact body will be explained. However, note that embodiments thereof are not limited to those shown in the drawings or described below.

(Brief Description of a Movable Contact Body for a Switch According to the Disclosed Embodiments)

The movable contact bodies according to the embodiments each include a holding member disposed so as to face a lower surface of a movable contact, the holding member having a contact through-hole through which a top portion of the movable contact can pass; the holding member holds the movable contact to prevent the movable contact from falling off during transfer.

(Structure and Function of a Movable Contact Body for a Switch According to a First Embodiment)

Figure 2:
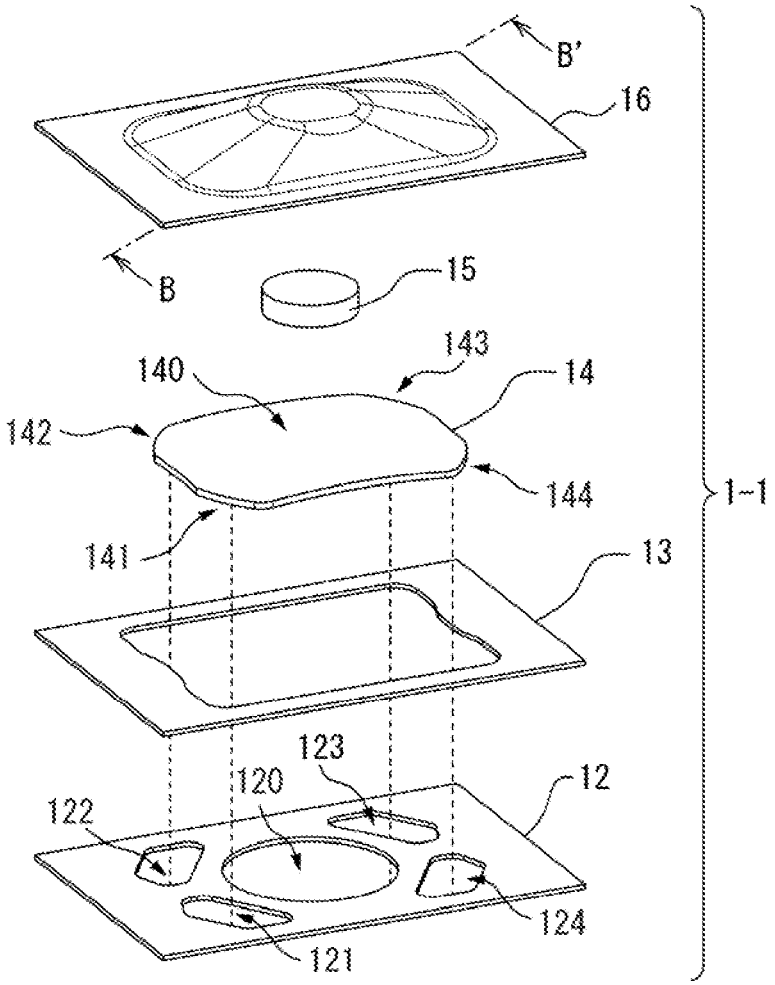
FIG. 2 is an exploded perspective view of the movable contact body shown in FIG. 1.
Figure 3:
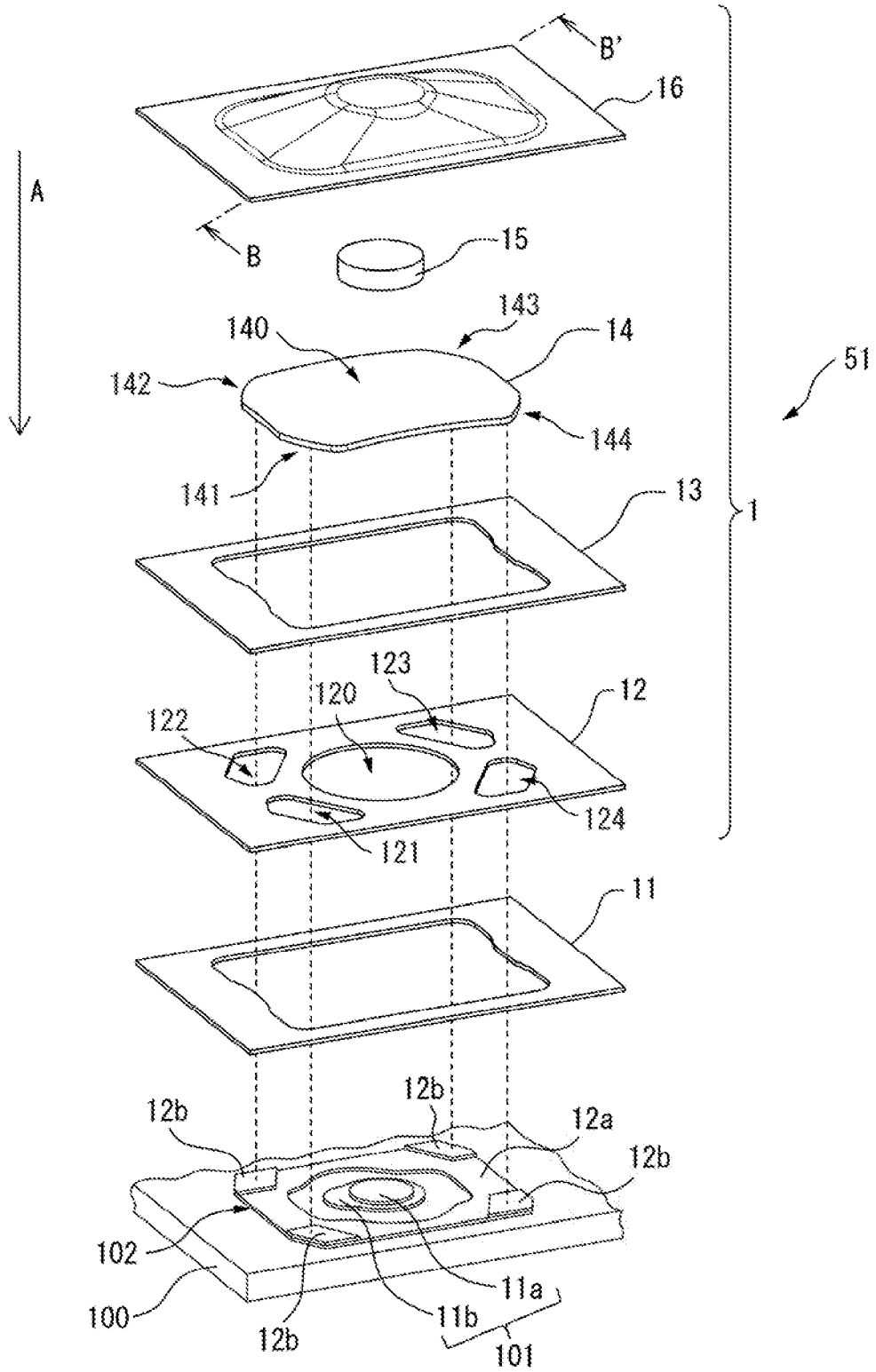
FIG. 3 is an exploded perspective view of a switch including the movable contact body shown in FIG. 1.
Figure 4:
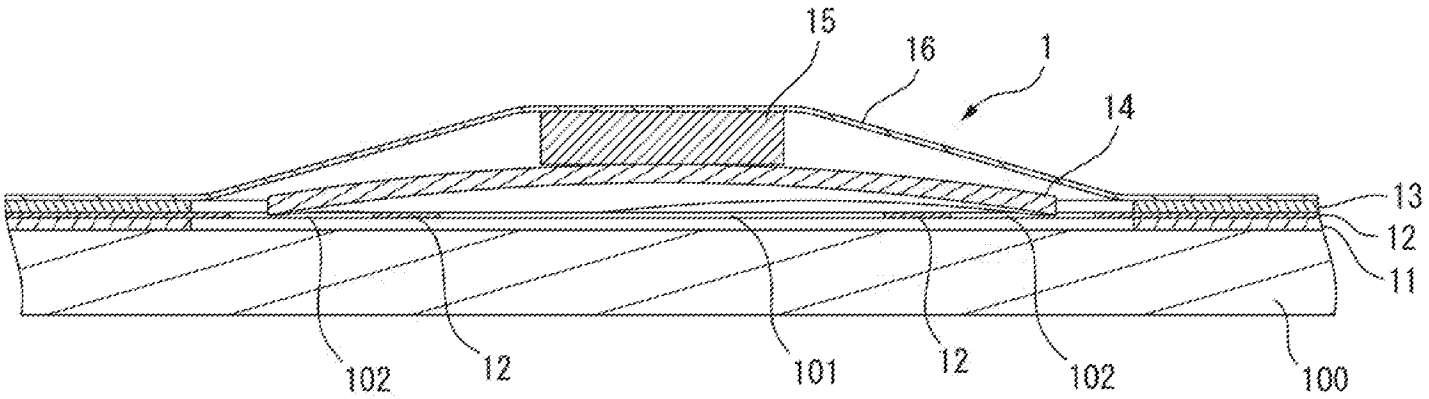
FIG. 4 is a cross-sectional view of the switch shown in FIG. 3, taken along line B-B'.

FIG. 1 is a perspective view of a movable contact body for a switch according to a first embodiment. FIG. 2 is an exploded perspective view of the movable contact body shown in FIG. 1. FIG. 3 is an exploded perspective view of a switch including the movable contact body shown in FIG. 1. FIG. 4 is a cross-sectional view of the switch shown in FIG. 3, taken along line B-B'.

The movable contact body 1-1 for a switch includes a holding sheet 12, an adhesive sheet 13, a movable contact 14, a pusher 15 and a cover sheet 16.

The holding sheet 12 is a quadrate holding member made of a synthetic resin, such as polyimide, polyamide and PET, and is disposed so as to face the lower surface of the movable contact 14 and holds the movable contact 14 from below. The holding sheet 12 has a contact through-hole 120 and first to fourth through-holes 121-124; the contact through-hole 120 faces a top portion of the movable contact 14, and includes at least a portion through which the top portion of the movable contact 14 can pass. The first to fourth through-holes 121-124 are formed around the contact through-hole 120 so that first to fourth edges 141-144, which are the four corners of the movable contact 14, can be inserted thereinto, respectively. The first to fourth through-holes 121-124 have regions into which at least the first to fourth edges 141-144 can be inserted, respectively. The holding sheet 12 holds the movable contact 14 with the first to fourth edges 141-144, which are the four corners of the movable contact 14, being inserted into the first to fourth through-holes 121-124, respectively.

The adhesive sheet 13 is a frame-shaped member including a base layer made of a synthetic resin, such as polyimide and PET, and adhesive layers made of an acrylic resin and disposed on both sides of the base layer, and bonds the holding sheet 12 and the cover sheet 16 together. The adhesive sheet 13 is formed so that at least regions of the first to fourth through-holes 121-124 into which the first to fourth edges 141-144 can be inserted are placed inside the frame of the adhesive sheet 13. The frame of the adhesive sheet 13 is shaped so that at least regions into which the first to fourth edges 141-144 can be inserted are placed inside the frame.

The movable contact 14 is a member made of stainless steel and having a leaf-spring shape, and is formed by cutting (D-cutting) the opposing sides of a convex dome-shaped leaf spring member and then chamfering the four corners of the leaf spring member. When it is pushed down in the pushing direction indicated by an arrow A from the top to the bottom in FIG. 3, the top portion 140 of the movable contact 14 is inverted and moved in the pushing direction to pass through the contact through-hole 120, and thereby can project below the holding sheet. The movable contact 14 is fixed to none of the other members in the movable contact body 1-1, and is disposed so as to be movable.

Figure 5:
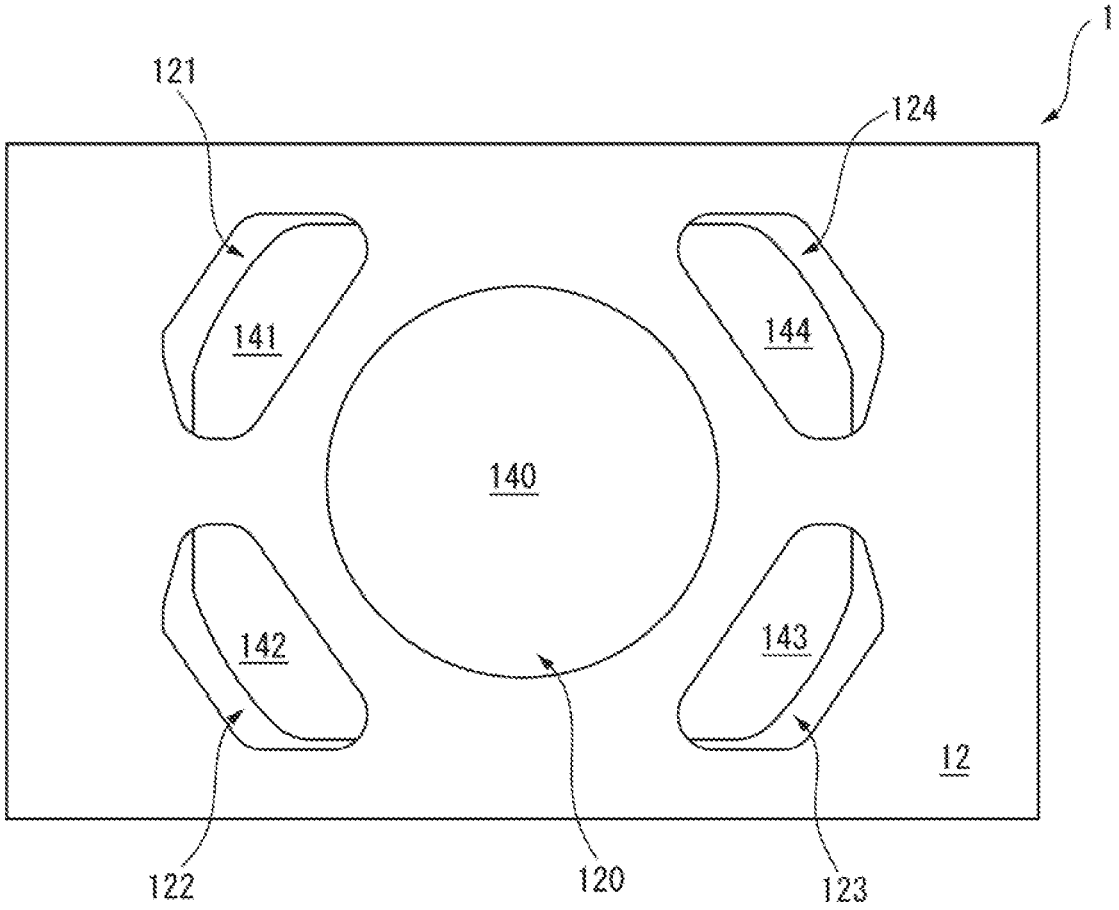
FIG. 5 shows the positional relationship between the gluing sheet, the holding sheet and the movable contact shown in FIG. 1.

FIG. 5 shows the positional relationship between the holding sheet 12 and the movable contact 14. FIG. 5 shows the movable contact body 1-1 viewed from below, i.e., shows the holding sheet 12 and the movable contact 14 in this order toward the back of the drawing plane.

The top portion 140 of the movable contact 14 is disposed so as to face the contact through-hole 120, by the first to fourth edges 141-144 being inserted into the first to fourth through-holes 121-124, respectively.

The pusher 15 is a cylindrical member made of a synthetic resin, such as polyimide and PET, and is disposed so that its lower and upper surfaces are in contact with the top portion 140 of the movable contact 14 and the cover sheet 16, respectively. The pusher 15 is fixed to the cover sheet 16 by an adhesive (not shown). The cover sheet 16 is a quadrate member made of a synthetic resin, such as polyimide, polyamide and PET; and its outer edges are bonded to the holding sheet 12 by the adhesive sheet 13.

The movable contact body 1-1 is bonded to a substrate 100 by a gluing sheet 11, thereby constituting a switch 51. The gluing sheet 11 is a frame-shaped member including a base layer made of a synthetic resin, such as polyimide and PET, a gluing layer made of an acrylic resin and disposed on the lower surface of the base layer, and an adhesive layer made of an acrylic resin and disposed on the upper surface of the base layer.

The substrate 100 is a rigid substrate made of an epoxy resin, for example. The substrate 100 has a first fixed contact 101 and a second fixed contact 102 formed thereon. The first fixed contact 101 is made of an electric conductor, such as copper, and includes a first contact base 11*b* and a cylindrical first contact projection 11*a* projecting from the first contact base 11*b*. The second fixed contact 102 is made of an electric conductor, such as copper, and includes a second contact base 12*a* and four second contact projections 12*b* projecting from the second contact base 12*a*. The shape of the first contact projection 11*b* is a circular cylinder, but may be a quadrangular prism or other shapes.

The movable contact body 1-1 is disposed so that the first to fourth edges 141-144 of the movable contact 14 are in contact with the second contact projections 12*b*, respectively. When a pushed portion 161 of the movable contact body 1-1 is not pushed down, the top portion 140 of the movable contact 14 is separated from the first contact projection 11*a*, and thus the first fixed contact 101 and the second fixed contact 102 are kept insulated from each other. When the first fixed contact 101 and the second fixed contact 102 are insulated, the switch 51 is off.

In response to the pushed portion 161 of the movable contact body 1-1 being pushed down, the top portion 140 of the movable contact 14 moves downward to come into contact with the first contact projection 11*a*, causing the first fixed contact 101 and the second fixed contact 102 to be electrically connected, which turns the switch 5 on. When the push-down of the pushed portion 161 of the movable contact body 1-1 is stopped, the top portion 140 of the movable contact 14 moves upward and is separated from the first contact projection 11*a*, causing the first fixed contact 101 and the second fixed contact 102 to be insulated from each other, which turns the switch 51 off.

The first fixed contact 101 is formed so that the height of the first contact base 11*b* is equal to or smaller than the thickness of the gluing sheet 11 and that the difference in height between the second contact projections 12*b* and the first contact projection 11*a* is larger than the thickness of the holding sheet 12. For example, if the thickness of the gluing sheet 11 is 30 μm and that of the holding sheet 12 is 5 μm or 13 μm, the height of the first contact base 11*b* is set at 50 μm. The height of the first contact projection 11*a* is set at 30 μm so that the difference in height between the first contact projection 11*a* and the second contact projections 12*a* is larger than 5 μm or 13 μm, which is the thickness of the holding sheet 12.

The first fixed contact 101 is formed by two-step etching wherein the first contact projection 11*a* and the first contact base 11*b* are formed by the first and second etching, respectively.

The second fixed contact 102 is formed so that the height of the second contact base 12*a* is equal to or smaller than the thickness of the gluing sheet 11 and that the difference in height between the second contact base 12*a* and the second contact projections 12*b* is larger than the thickness of the holding sheet 12. For example, if the thickness of the gluing sheet 11 is 30 μm and that of the holding sheet 12 is 5 μm or 13 μm, the height of the second contact base 12*a* is set at 30 μm. The height of the second contact projections 12*b* is set at 50 μm so that the difference in height between the second contact base 12*a* and the second contact projections 12*b* is larger than 5 μm or 13 μm, which is the thickness of the holding sheet 12.

The second fixed contact 102 is formed by two-step etching wherein the second contact projections 12*b* and the second contact base 12*a* are formed by the first and second etching, respectively.

(Steps for Manufacturing the Movable Contact Body According to the First Embodiment)

Figure 6:
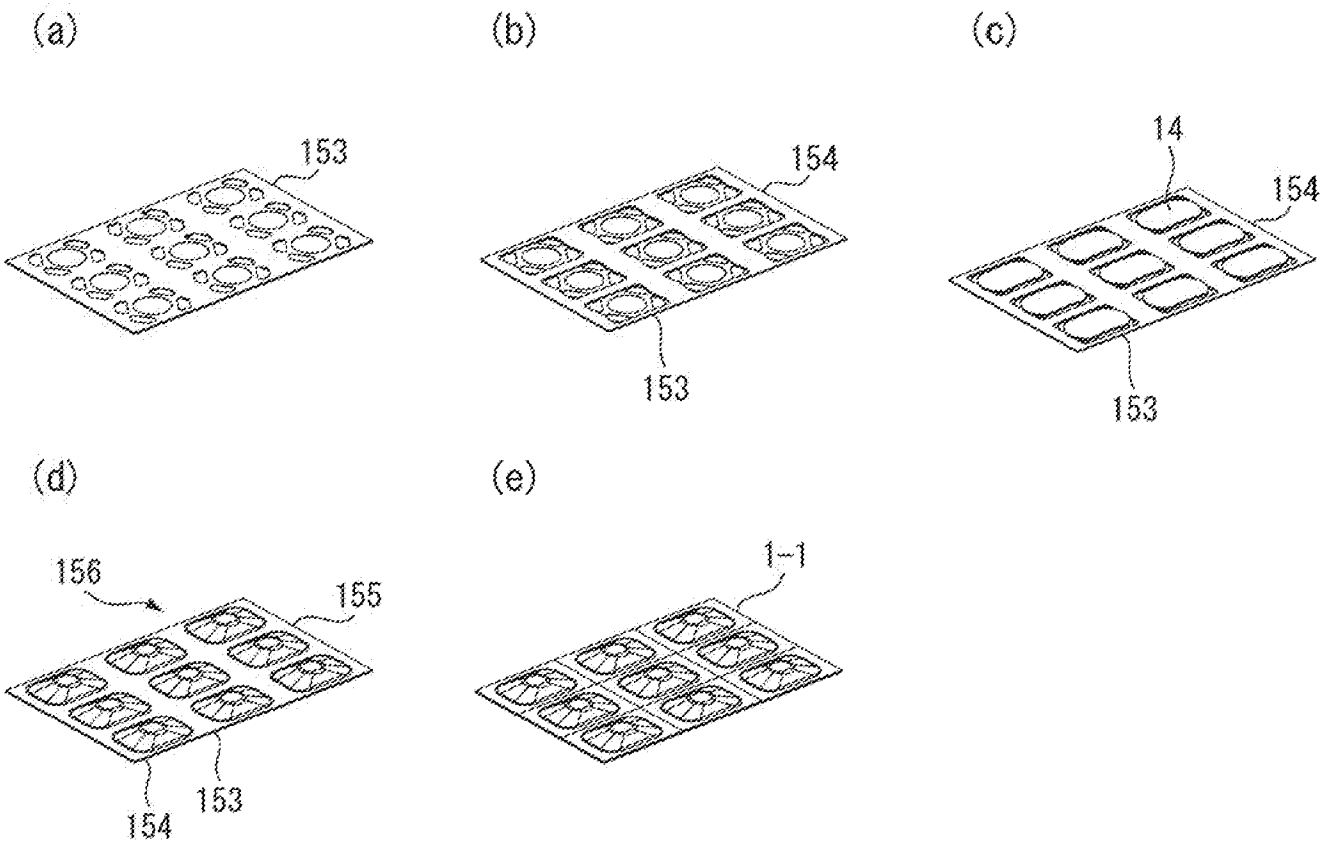
FIG. 6 shows steps for manufacturing the movable contact body shown in FIG. 1; (a) shows the first step, (b) shows the second step, (c) shows the third step, (d) shows the fourth step, and (e) shows the fifth step.

FIG. 6 shows steps for manufacturing the movable contact body shown in FIG. 1; (a) shows the first step, (b) shows the second step, (c) shows the third step, (d) shows the fourth step, and (e) shows the fifth step.

First, an apparatus (not shown) for manufacturing the movable contact body 1-1 affixes an adhesive sheet member 154 including frames each corresponding to the adhesive sheet 13, to a holding sheet member 153. In this affixing process, the manufacturing apparatus layers a separator member 151, the holding sheet member 153 and the adhesive sheet member 154 with pins of a jig (not shown) placed therearound. Next, the manufacturing apparatus attaches movable contacts 14 so that the first to fourth through-holes 121-124 are inserted into holes corresponding to the first to fourth through-holes 121-124, respectively. Next, the manufacturing apparatus affixes a flat-shaped cover sheet member 155 including cover sheets 16 respectively having pushers 15 bonded thereto, to the adhesive sheet member 154, thereby forming an array 156 of the movable contact bodies each having a structure corresponding to the movable contact body 1-1. In this affixing process, the manufacturing apparatus heats the members 151-155 to approximately 120 to 170° C. Then, the manufacturing apparatus dices the array 156 of the movable contact bodies into pieces, thereby producing the movable contact body 1-1.

(Operational Advantages of the Movable Contact Body and the Switch According to the First Embodiment)

The movable contact body 1-1 includes the holding member 12 disposed so as to face the lower surface of the movable contact 14, the holding member 12 having the contact through-hole 120 through which the top portion 140 of the movable contact 14 can pass; the holding member 12 holds the movable contact 14 to prevent the movable contact 14 from falling off during transfer.

In the movable contact body 1-1, the top portion 140 of the movable contact 14 is disposed at a position facing the contact through-hole 120, by the first to fourth edges 141-144 being inserted into the first to fourth through-holes 121-124, respectively.

Since the switch 51 includes members bonded together by the adhesive sheet 13 without solder, solder reflow for soldering can be omitted. This allows for preventing the occurrence of variations in spring characteristics of the movable contact 14 caused by the solder reflow varying the spring characteristics. Since solder reflow involving heating to high temperatures over 200° C. can be omitted, inexpensive members having a low heat resistance can be employed for the switch 51.

The first fixed contact 101 and the second fixed contact 102 of the switch 51 are formed so that the height of the base is equal to or smaller than the thickness of the gluing sheet 11 and that the difference in height between the projections and the base is larger than the thickness of the holding sheet 12. The features that the height of the base is equal to the thickness of the gluing sheet 11 and that the difference in height between the projections and the base is larger than the thickness of the holding sheet 12 prevent the movable contact 14 from coming into contact with the holding sheet 12 when the switch 51 is not pushed down.

In the switch 51, since the height of the second contact base 12*a* is equal to the thickness of the gluing sheet 11, when the holding sheet 12 is bonded to the gluing sheet 11, the holding sheet 12 is disposed in contact with the surface of the second contact base 12*a* without being curved. Since the holding sheet 12 of the switch 51 is disposed without being curved, even if the switch 51 is pushed down to cause the holding sheet 12 to repeatedly come in contact with the movable contact 14, breakage of the holding sheet 12 is unlikely to occur.

Since the switch 51 includes the first fixed contact 101 and the second fixed contact 102 formed on the substrate 100, costs of members and man-hours required for assembling can be reduced as compared to the case where a submount substrate or a lead frame included in a conventional switch is soldered to a substrate; thus, cost reduction is possible.

(Structure and Function of a Movable Contact Body for a Switch According to a Second Embodiment)

Figure 7:
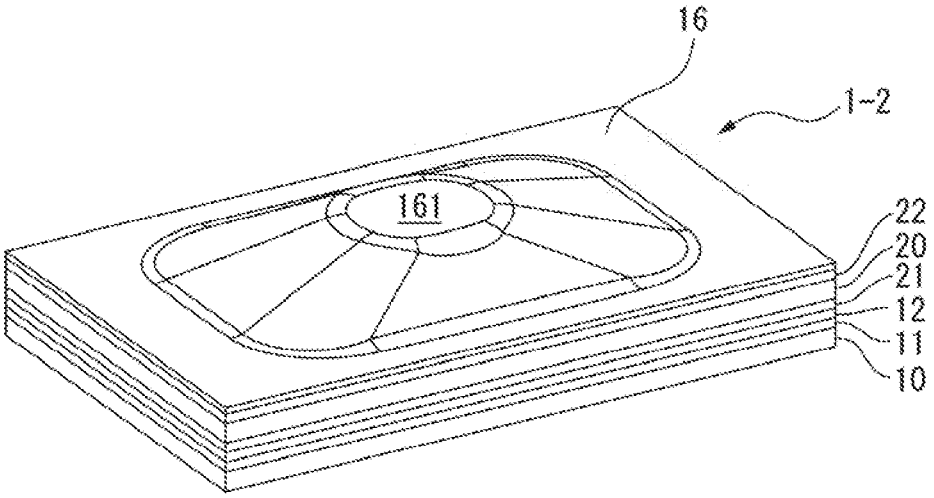
FIG. 7 is a perspective view of a movable contact body for a switch according to a second embodiment.
Figure 8:
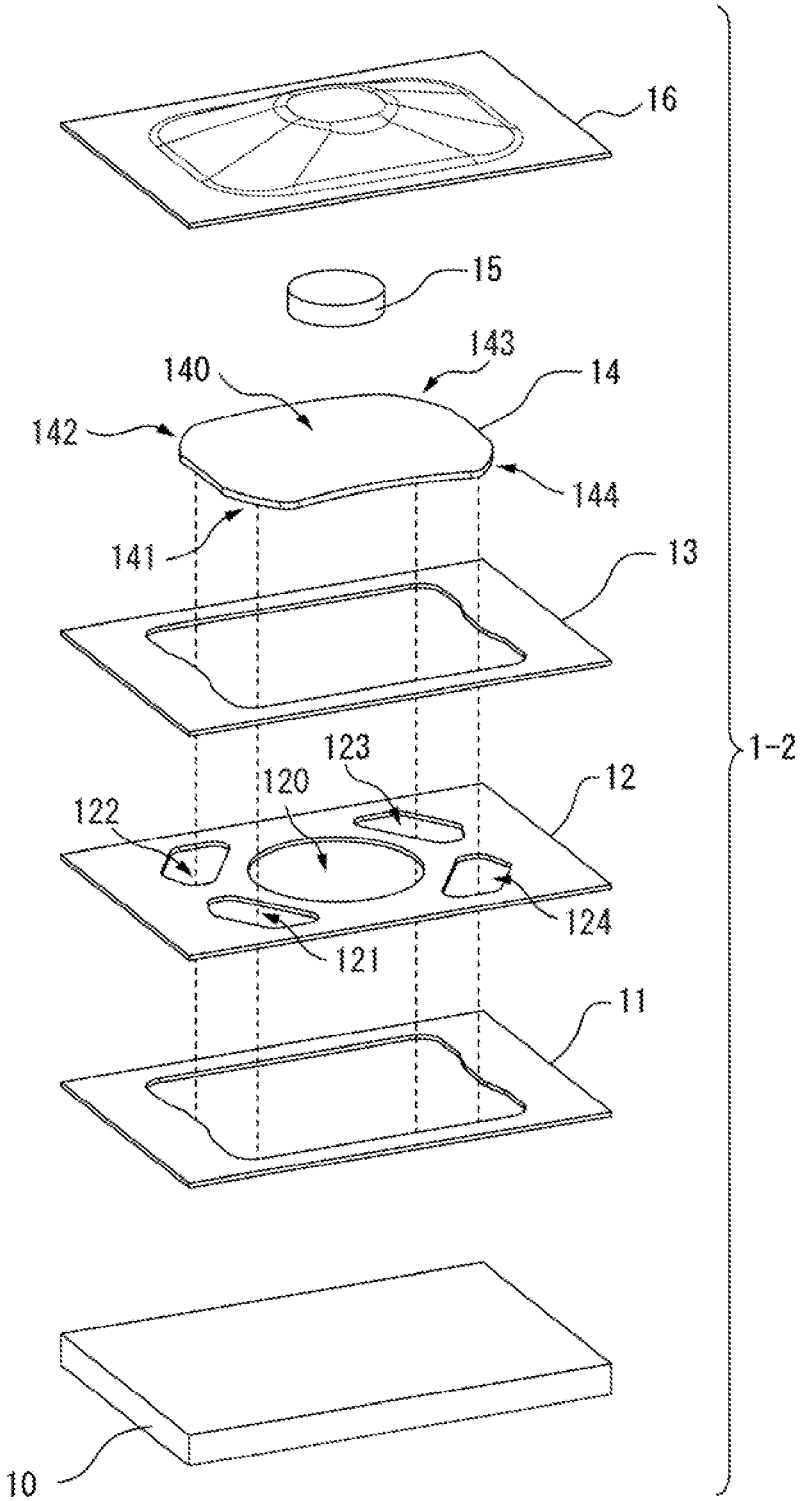
FIG. 8 is an exploded perspective view of the movable contact body shown in FIG. 7.
Figure 9:
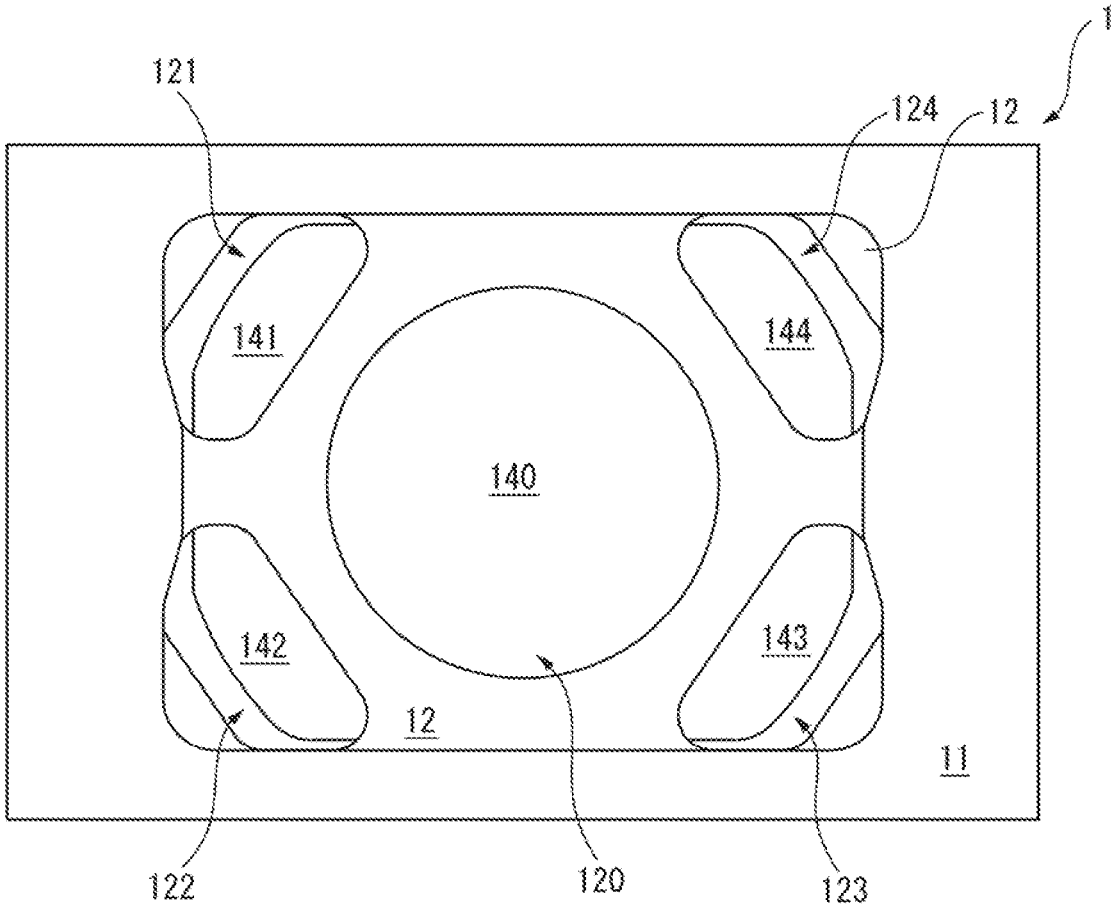
FIG. 9 shows the positional relationship between the gluing sheet, the holding sheet and the movable contact shown in FIG. 7.

FIG. 7 is a perspective view of a movable contact body for a switch according to a second embodiment. FIG. 8 is an exploded perspective view of the movable contact body shown in FIG. 7. FIG. 9 shows the positional relationship between the gluing sheet, the holding sheet and the movable contact shown in FIG. 7.

The movable contact body 1-2 for a switch differs from the movable contact body 1-1 in that it includes a separator 10 and a gluing sheet 11. Since the structure and function of components of the movable contact body 1-2 are the same as those of the movable contact body 1-1 assigned the same reference numerals, except for the separator 10 and the gluing sheet 11, detailed description thereof is omitted herein.

The separator 10 is a quadrate member made of a synthetic resin, such as polyethylene terephthalate (PET), and having a coating for pealing applied thereon, and protects the movable contact 14 when the movable contact body 1-2 is stored and transferred. The separator 10 is removed when the movable contact body 1-2 is bonded to a substrate (not shown) having fixed contacts formed thereon.

The gluing sheet 11 includes a gluing layer joined to the separator 10 so as to be peelable, and an adhesive layer adhering to the holding sheet 12. The adhesive strength between the gluing sheet 11 and the holding sheet 12 is stronger than the adhesive strength between the gluing sheet 11 and the separator 10; thus, when the separator 10 is peeled off from the gluing sheet 11, the holding sheet 12 is not peeled off from the gluing sheet 11. The adhesion of the gluing sheet 11 is maintained even after the separator 10 is peeled off; thus, when the movable contact body 1-2 is bonded to a substrate (not shown) having fixed contacts, the gluing sheet 11 functions as an adhesive member bonding the movable contact body 1-2 and the substrate together. In the movable contact bodies according to the embodiments, a thermosetting adhesive sheet may be used instead of the gluing sheet 11.

As shown in FIG. 9, the first to fourth through-holes 121-124 are formed so that at least regions into which the first to fourth edges 141-144 can be inserted are placed inside the frame of the gluing sheet 11. The frame of the gluing sheet 11 may have the same shape as that of the adhesive sheet 13. Since the peel strength between the gluing sheet 11 and the separator 10 is weaker than the adhesive strength of the adhesive sheet 13, the adhesive sheet 13 is not peeled off. The movable contact body 1-2 is bonded to the substrate 100 by the gluing sheet 11 with the separator 10 being peeled off, thereby constituting the switch 51.

The first to fourth through-holes 121-124 of the holding sheet 12 and the movable contact 14 are disposed inside the frame of the gluing sheet 11. The gluing sheet 11 and the holding sheet 12 are bonded together so that the first to fourth edges 141-144 of the movable contact 14 can be inserted into the first to fourth through-holes 121-124, respectively.

(Steps for Manufacturing the Movable Contact Body According to the Second Embodiment)

Figure 10:
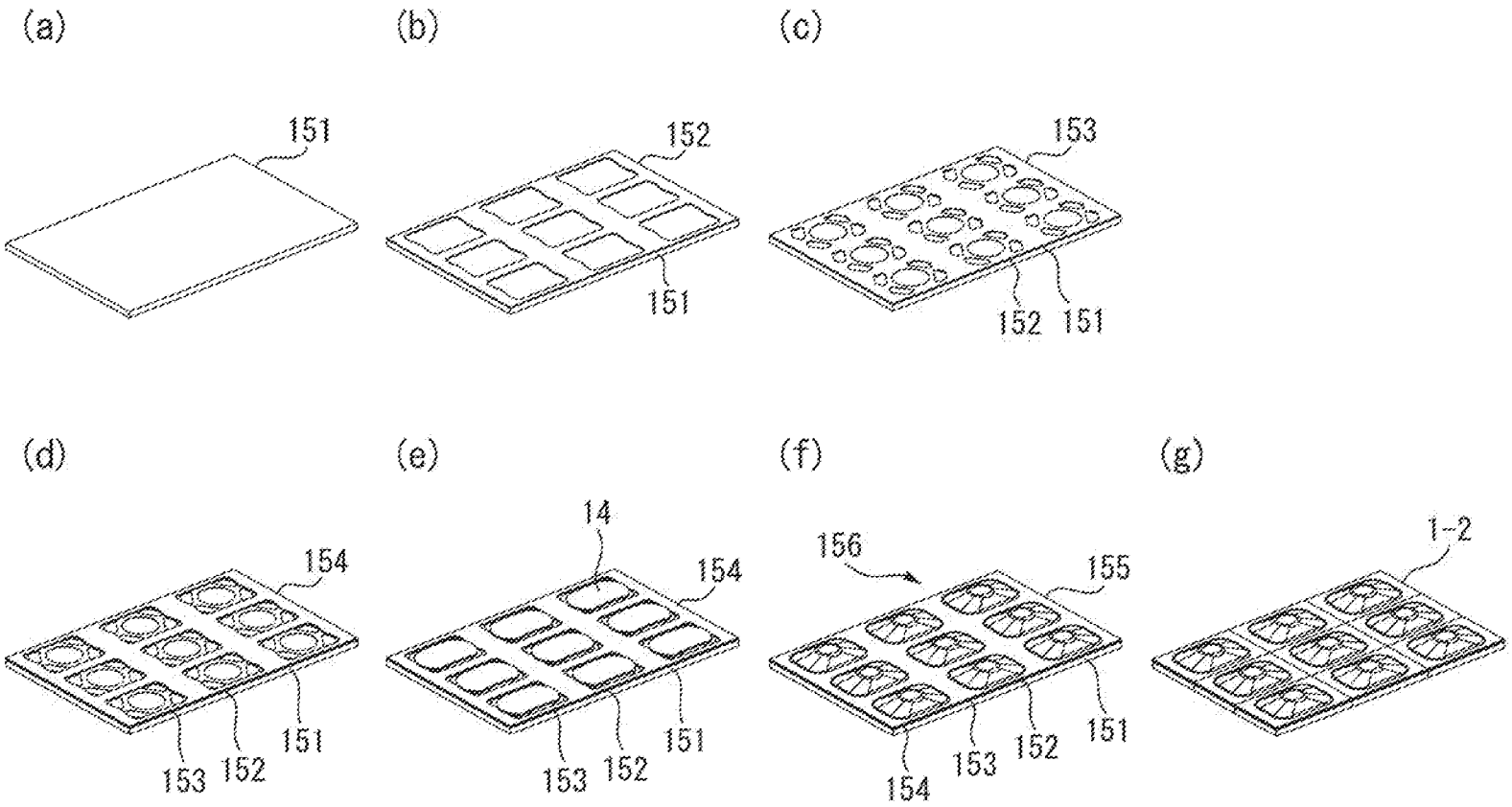
FIG. 10 shows steps for manufacturing the movable contact body shown in FIG. 7; (a) shows the first step. (b) shows the second step, (c) shows the third step, (d) shows the fourth step, (e) shows the fifth step, (f) shows the sixth step, and (g) shows the seventh step.

FIG. 10 shows steps for manufacturing the movable contact body 1-2; (a) shows the first step, (b) shows the second step, (c) shows the third step, (d) shows the fourth step, (e) shows the fifth step. (f) shows the sixth step, and (g) shows the seventh step.

First, an apparatus (not shown) for manufacturing the movable contact body 1-2 affixes a gluing sheet member 152 including frames each corresponding to the gluing sheet 11, to a flat-shaped separator member 151 which becomes separators 10. Next, the manufacturing apparatus affixes a holding sheet member 153 having holes corresponding to the contact through-hole 120 and the first to fourth through-holes 121-124, to the surface of the gluing sheet member 152 affixed to the separator member 151.

Since the third to seventh steps are the same as the first to fifth steps for manufacturing the movable contact body 1-1 described with reference to FIG. 6, detailed description thereof is omitted herein.

(Operational Advantages of the Movable Contact Body and the Switch According to the Second Embodiment)

Since the movable contact body 1-2 includes the separator 10 disposed so as to cover the holding sheet 12 and the movable contact 14, the movable contact 14 can be protected when the movable contact body 1-2 is stored and transferred.

(Structure and Function of a Movable Contact Body for a Switch According to a Third Embodiment)

Figure 11:
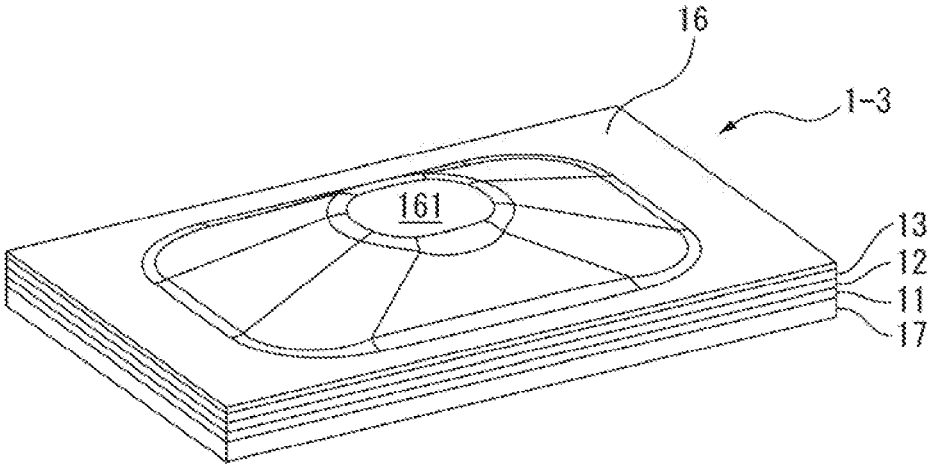
FIG. 11 is a perspective view of a movable contact body for a switch according to a third embodiment.
Figure 12:
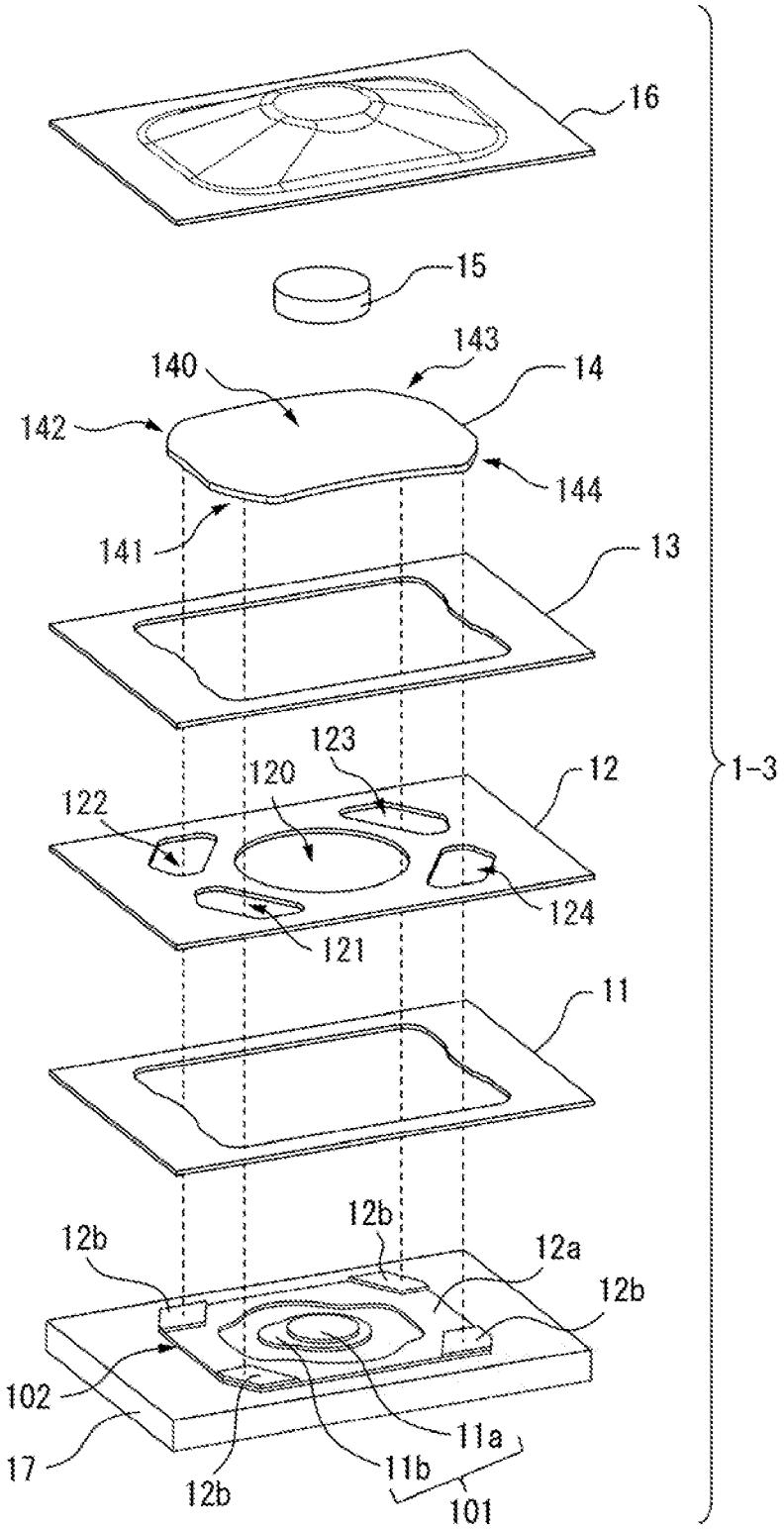
FIG. 12 is an exploded perspective view of the movable contact body shown in FIG. 11.

FIG. 11 is a perspective view of a movable contact body for a switch according to a third embodiment. FIG. 12 is an exploded perspective view of the movable contact body shown in FIG. 11.

The movable contact body 1-3 for a switch differs from the movable contact body 1-1 in that it includes a substrate 17 instead of the separator 10. Since the structure and function of components of the movable contact body 1-3 are the same as those of the movable contact body 1-1 assigned the same reference numerals, except for the separator 10, detailed description thereof is omitted herein.

The substrate 17 has a first fixed contact 101 and a second fixed contact 102, similarly to the substrate 100. Since the first fixed contact 101 and the second fixed contact 102 have already been described with reference to FIG. 5, for example, detailed description thereof is omitted herein.

(Steps for Manufacturing the Movable Contact Body According to the Third Embodiment)

Figure 13:
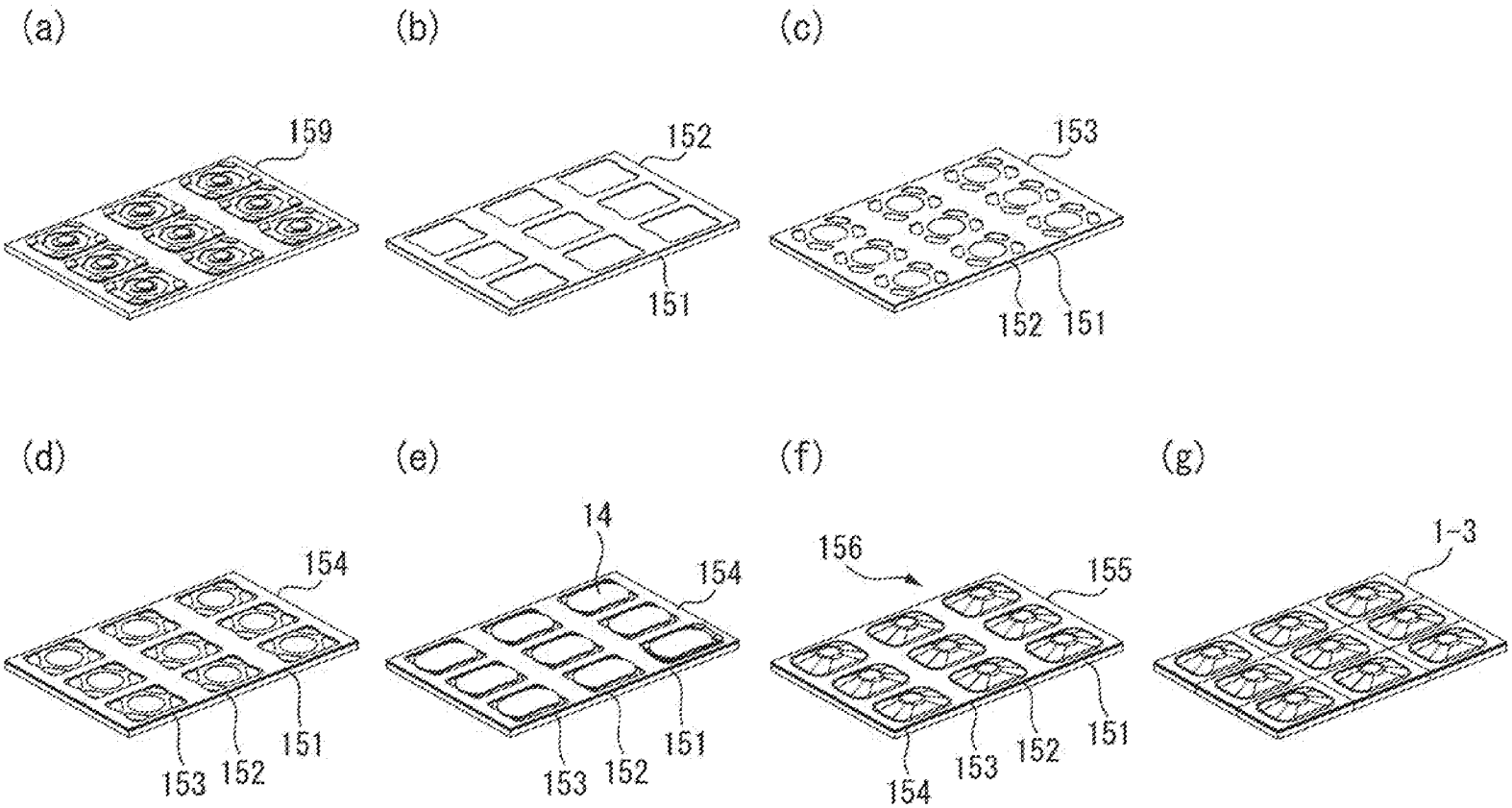
FIG. 13 shows steps for manufacturing the movable contact body shown in FIG. 11; (a) shows the first step, (b) shows the second step, (c) shows the third step. (d) shows the fourth step, (e) shows the fifth step, (f) shows the sixth step, and (g) shows the seventh step.

FIG. 13 shows steps for manufacturing the movable contact body 1-3; (a) shows the first step, (b) shows the second step, (c) shows the third step, (d) shows the fourth step, (e) shows the fifth step, (t) shows the sixth step, and (g) shows the seventh step.

First, an apparatus (not shown) for manufacturing the movable contact body 1-3 affixes a gluing sheet member 152 including frames each corresponding to the gluing sheet 11, to a flat-shaped substrate member 159 including substrates 17.

Since the second to seventh steps are the same as the second to seventh steps for manufacturing the movable contact body 1-2 described with reference to FIG. 10, detailed description thereof is omitted herein.

(Operational Advantages of the Movable Contact Body and the Switch According to the Third Embodiment)

Since the movable contact body 1-3 includes the substrate member 159 disposed so as to cover the holding sheet 12 and the movable contact 14, the movable contact 14 can be protected when the movable contact body 1-3 is stored and transferred.

As for the movable contact body 1-3, since the substrate 17 having the first fixed contact 101 and the second fixed contact 102 is used as a separator, the switch 1-3 can be easily formed by dicing into pieces.

(Structure and Function of a Movable Contact Body for a Switch According to a Fourth Embodiment)

Figure 14:
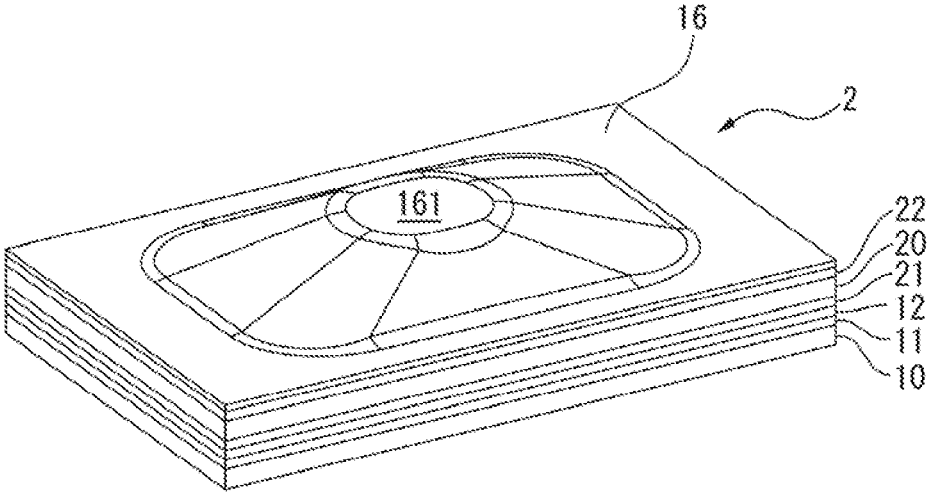
FIG. 14 is a perspective view of a movable contact body for a switch according to a fourth embodiment.
Figure 15:
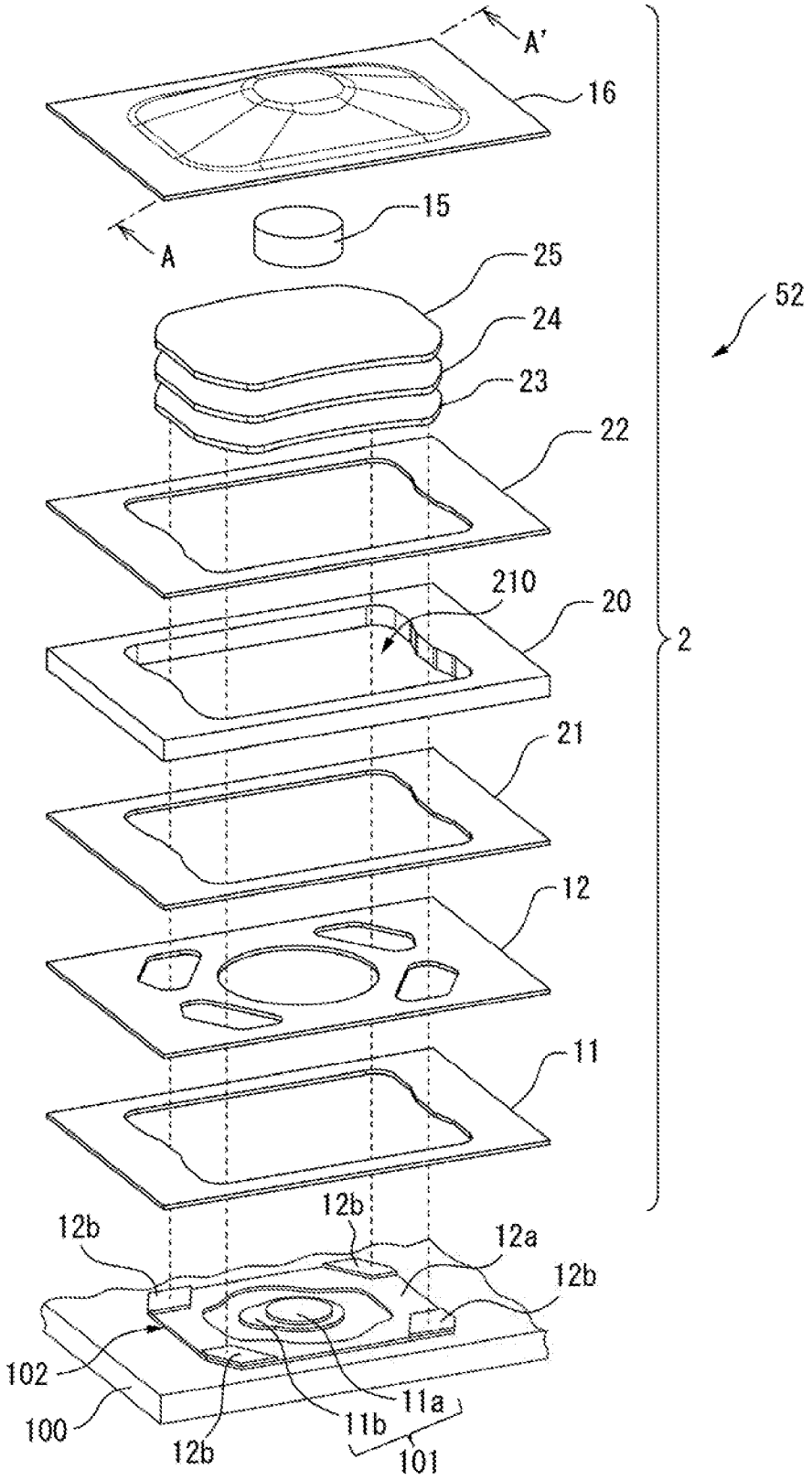
FIG. 15 is an exploded perspective view of a switch including the movable contact body shown in FIG. 14.
Figure 16:
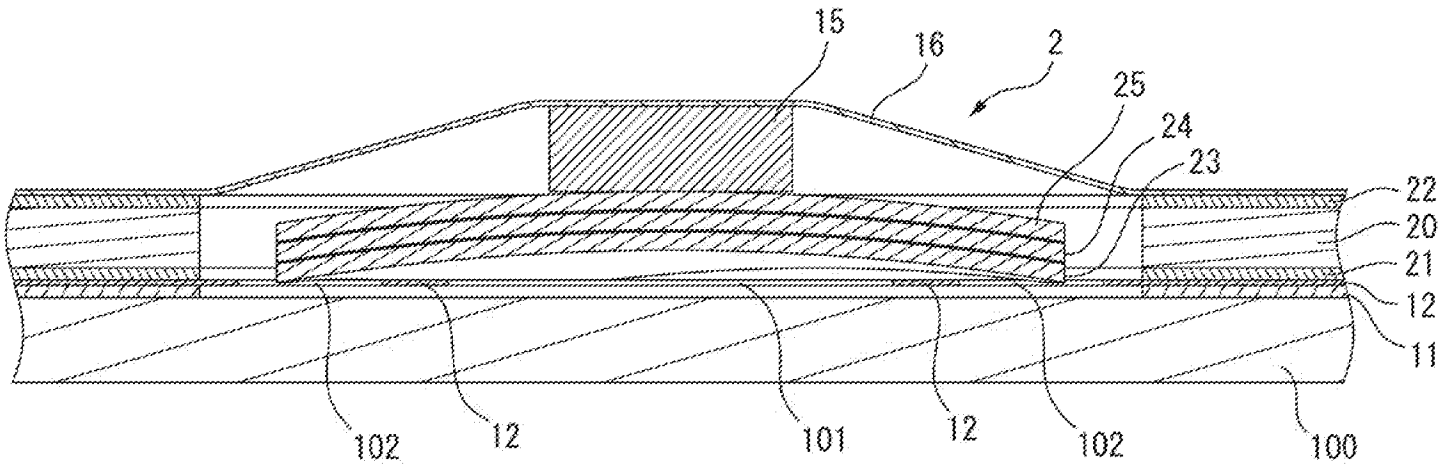
FIG. 16 is a cross-sectional view of the switch shown in FIG. 15, taken along line A-A'.

FIG. 14 is a perspective view of a movable contact body for a switch according to a fourth embodiment. FIG. 15 is an exploded perspective view of a switch including the movable contact body shown in FIG. 14. FIG. 16 is a cross-sectional view of the switch shown in FIG. 15, taken along line A-A'.

The movable contact body 2 for a switch differs from the movable contact body 1-2 in that it includes a base sheet 20, a first adhesive sheet 21 and a second adhesive sheet 22 instead of the adhesive sheet 13. The movable contact body 2 also differs from the movable contact body 1-2 in that it includes first to third movable contacts 23-25 instead of the movable contact 14. The structure and function of components of the movable contact body 2 are the same as those of the movable contact body 1-2 assigned the same reference numerals, except for the base sheet 20, the first adhesive sheet 21, the second adhesive sheet 22 and the first to third movable contacts 23-25. Accordingly, detailed description of the structure and function of components of the movable contact body 2, except for the base sheet 20, the first adhesive sheet 21, the second adhesive sheet 22 and the first to third movable contacts 23-25, is omitted herein.

The base sheet 20 is a quadrate fixing member made of a synthetic resin, such as polyimide and PET, and has a hole 210 for housing the first to third movable contacts 23-25 to fix the movable contacts. The frame of the base sheet 20 may have the same shape as the frames of the gluing sheet 11 and the adhesive sheet 13. The base sheet 20 is bonded to the holding sheet 12 by the first adhesive sheet 21, and to the cover sheet 16 by the second adhesive sheet 22.

The first adhesive sheet 21 is a frame-shaped member which includes a base layer made of a synthetic resin, such as polyimide and PET, and adhesive layers made of an acrylic resin and disposed on both sides of the base layer and bonds the holding sheet 12 and the base sheet 20 together. The second adhesive sheet 22 is a frame-shaped member which includes a base layer made of a synthetic resin, such as polyimide and PET, and adhesive layers made of an acrylic resin and disposed on both sides of the base layer and bonds the cover sheet 16 and the base sheet 20 together. The frames of the first adhesive sheet 21 and the second adhesive sheet 22 may have the same shape as the frame of the base sheet 20.

The first to third movable contacts 23-25 each have the same structure as the movable contact 14, and are layered in the order of the first movable contact 23, the second movable contact 24 and the third movable contact 25. The first to third movable contacts 23-25 are not fixed to each other. The first to third movable contacts 23-25 are fixed to none of the other members in the movable contact body 2, and are disposed so as to be movable. The first to third movable contacts 23-25 are inverted by the top portion of the third movable contact 25 being pushed down through the pusher 15; then, the top portion of the first movable contact 23 moves in the pushing direction, and thereby can project below the holding sheet.

The movable contact body 2 is bonded to the substrate 100 by the gluing sheet 11 with the separator 10 being peeled off, thereby constituting a switch 52. The substrate 100 has a first fixed contact 101 and a second fixed contact 102 formed thereon. In response to the pushed portion 161 of the movable contact body 2 being pushed down, the top portions of the first to third movable contacts 23-25 move downward, causing the top portion of the first movable contact 23 to come into contact with the first contact projection 11*a*, which turns the switch 52 on. When the push-down of the pushed portion 161 of the movable contact body 2 is stopped, the top portions of the first to third movable contacts 23-25 move upward, causing the top portion of the first movable contact 23 to be separated from the first contact projection 11*a*, which turns the switch 52 off.

(Steps for Manufacturing the Movable Contact Body According to the Fourth Embodiment)

Figure 17:
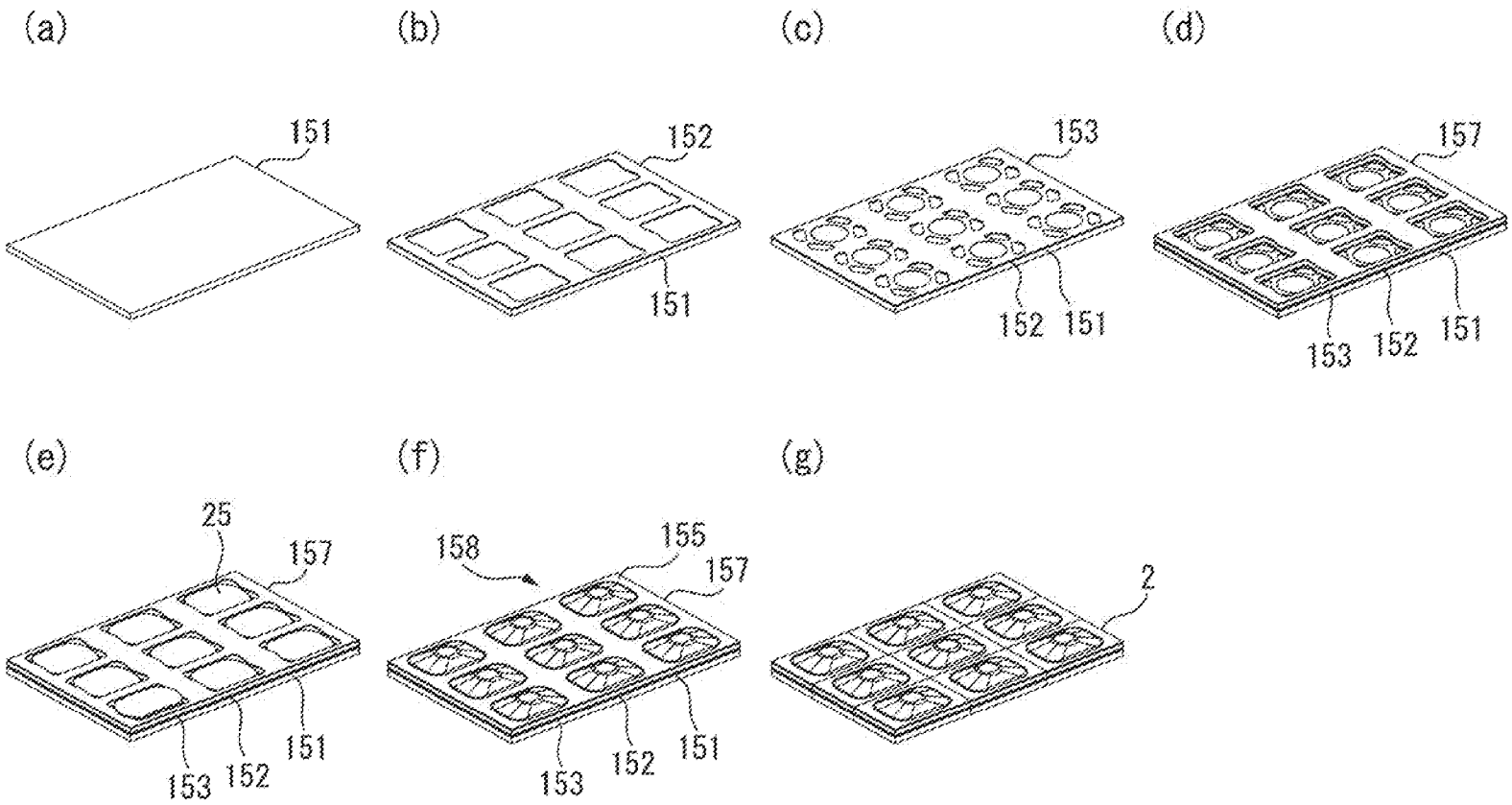
FIG. 17 shows steps for manufacturing the movable contact body shown in FIG. 14; (a) shows the first step. (b) shows the second step, (c) shows the third step, (d) shows the fourth step, (e) shows the fifth step, (f) shows the sixth step, and (g) shows the seventh step.

FIG. 17 shows steps for manufacturing the movable contact body shown in FIG. 14; (a) shows the first step, (b) shows the second step, (c) shows the third step, (d) shows the fourth step, (e) shows the fifth step, (f) shows the sixth step, and (g) shows the seventh step.

First, an apparatus (not shown) for manufacturing the movable contact body 2 affixes a gluing sheet member 152 to a flat-shaped separator member 151 which becomes separators 10. Next, the manufacturing apparatus affixes a holding sheet member 153 to the surface of the gluing sheet member 152 affixed to the separator member 151.

Next, the manufacturing apparatus affixes a base sheet member 157 to the holding sheet member 153, the base sheet member 157 being composed of a flat member corresponding to the base sheet 20 and members corresponding to the first adhesive sheet 21 and the second adhesive sheet 22 bonded on the respective surfaces of the flat member. The base sheet member 157 includes frames corresponding to the base sheet 20, the first adhesive sheet 21 and the second adhesive sheet 22. In this affixing process, the manufacturing apparatus heats the members 151-153 and the base sheet member 157 to approximately 170° C. Next, the manufacturing apparatus disposes the first to third movable contacts 23-25 in sequence in the frames formed in the base sheet member 157.

Next, the manufacturing apparatus affixes a flat-shaped cover sheet member 155 including cover sheets 16 respectively having pushers 15 bonded thereto, to an adhesive sheet member 154, thereby forming an array 158 of the movable contact bodies each having a structure corresponding to the movable contact body 2. Then, the manufacturing apparatus dices the array 158 of the movable contact bodies into pieces, thereby producing the movable contact body 2.

(Operational Advantages of the Movable Contact Body and the Switch According to the Fourth Embodiment)

The movable contact body 2 includes the layered first to third movable contacts 23-25 as the movable contact, which provides a more favorable sense of click than the movable contact bodies 1-1 to 1-3 when the movable contact body is pushed down. Since layering multiple movable contact bodies reduces load applied to each spring, durability can be improved even if the spring is small in area. Further, setting the height of the first contact projection 11*a* at 35 μm, which is smaller than the height of the second contact projections 12*b*, allows for improving durability of the spring.

Since the holding sheet 12 holds the first to third movable contacts 23-25 from below, the first to third movable contacts 23-25 can be prevented from falling off when the movable contact body 2 is transferred onto the substrate 100.

(Movable Contact Body According to a Fifth Embodiment)

Figure 18:
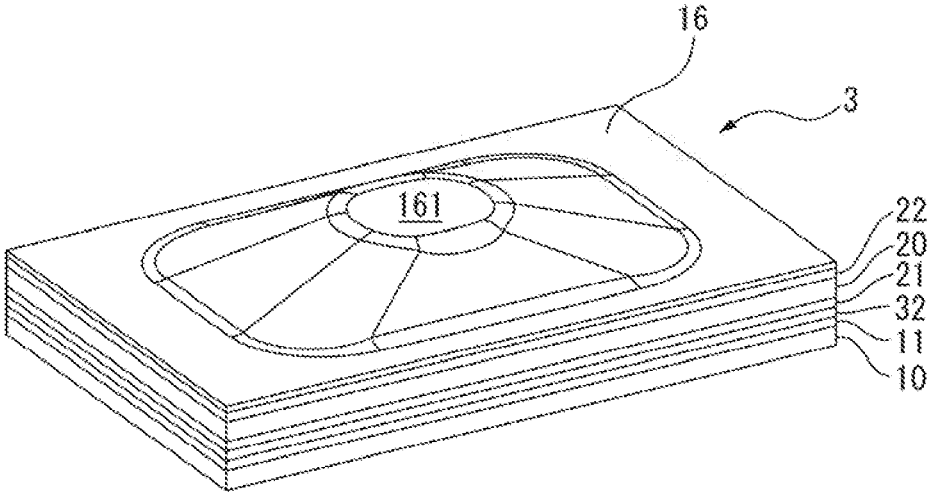
FIG. 18 is a perspective view of a movable contact body for a switch according to a fifth embodiment.
Figure 19:
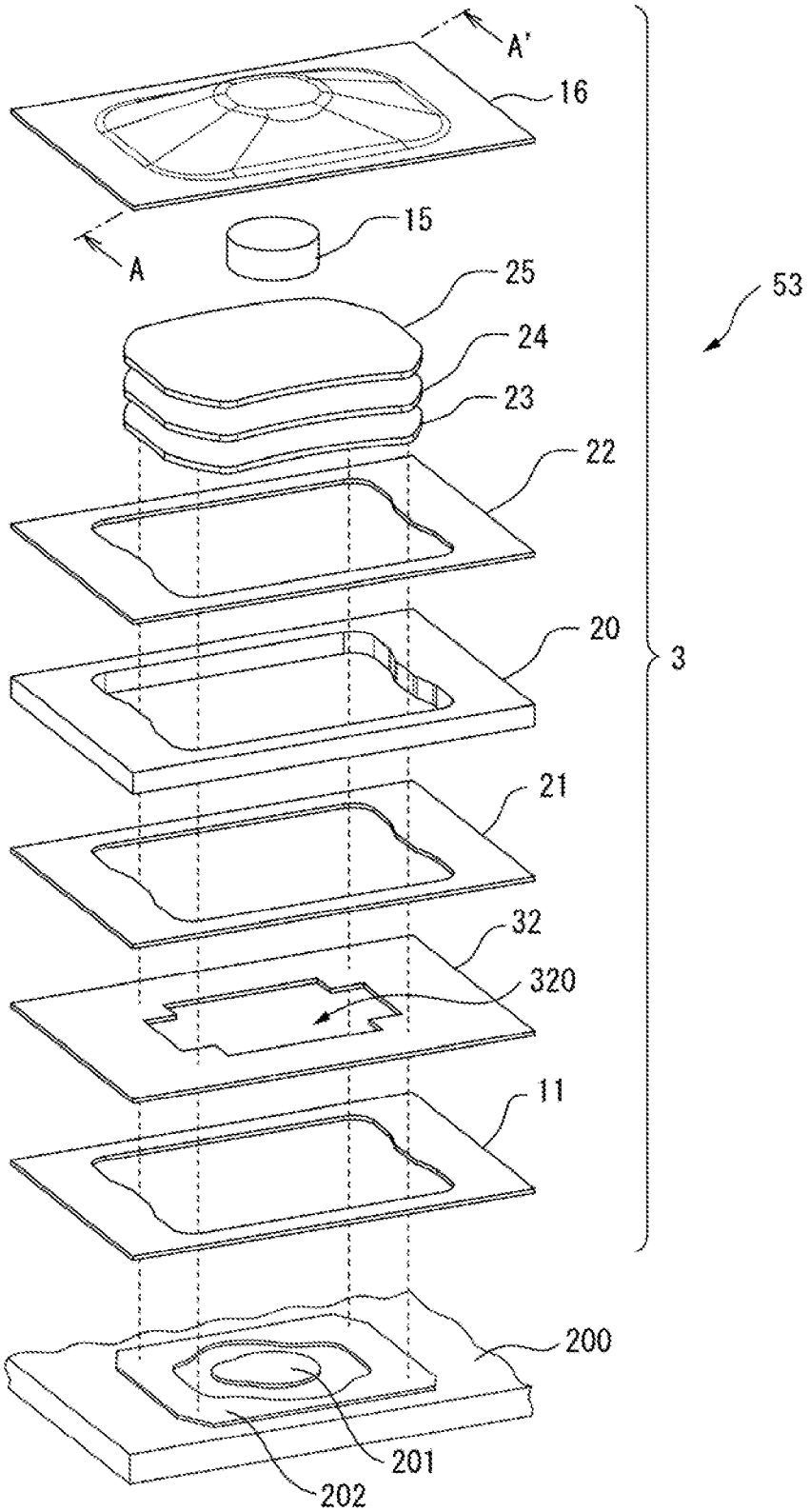
FIG. 19 is an exploded perspective view of a switch including the movable contact body shown in FIG. 18.
Figure 20:
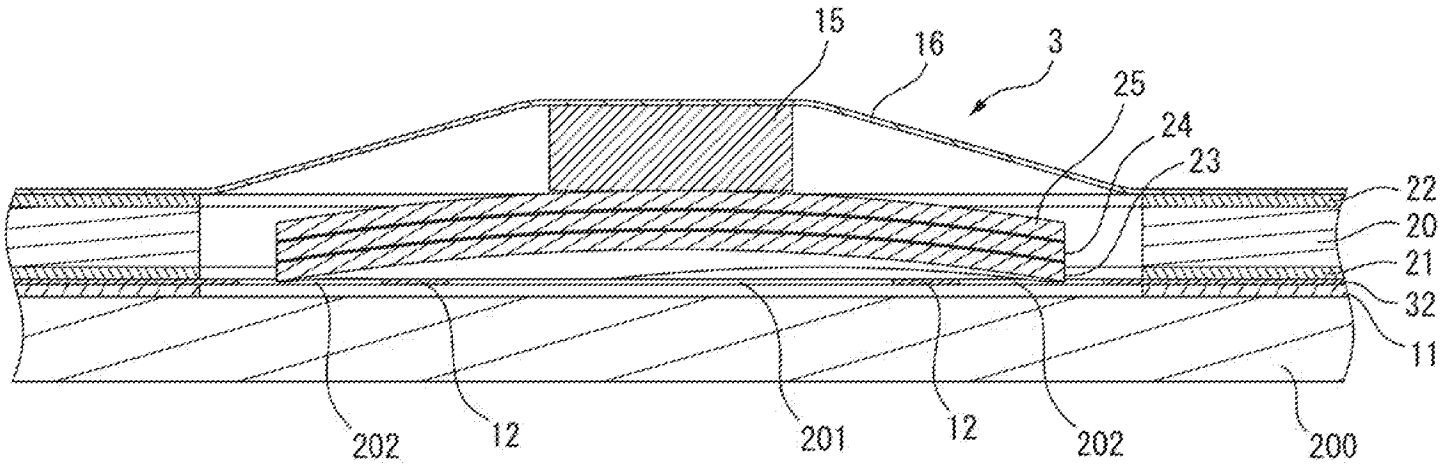
FIG. 20 is a cross-sectional view of the switch shown in FIG. 19, taken along line A-A'.

FIG. 18 is a perspective view of a movable contact body for a switch according to a fifth embodiment. FIG. 19 is an exploded perspective view of a switch including the movable contact body shown in FIG. 18. FIG. 20 is a cross-sectional view of the switch shown in FIG. 19, taken along line A-A'.

The movable contact body 3 for a switch differs from the movable contact body 2 in that it includes a holding sheet 32 instead of the holding sheet 12. Since the structure and function of components of the movable contact body 3 are the same as those of the movable contact body 2 assigned the same reference numerals, except for the holding sheet 32, detailed description thereof is omitted herein.

The holding sheet 32 is a quadrate holding member composed of a flat plated member and an electrically conductive member, such as a rolled copper foil, and is disposed so as to face the lower surface of the first movable contact 23 and holds the first to third movable contacts 23-25 from below. The holding sheet 32 has a contact through-hole 320 facing a top portion of the movable contact and including at least a portion through which the top portion of the first movable contact 23 can pass. The holding sheet 32 supports the base of the first movable contact 23 to hold the first to third movable contacts 23-25.

The movable contact body 3 is bonded to a substrate 200 by the gluing sheet 11 with the separator 10 being peeled off, thereby constituting a switch 53. The substrate 200 has a first fixed contact 201 and a second fixed contact 202 formed thereon. The first fixed contact 201 is made of an electric conductor, such as copper. The second fixed contact 202 is made of an electric conductor, such as copper. In response to the pushed portion 161 of the movable contact body 3 being pushed down, the top portions of the first to third movable contacts 23-25 move downward, causing the top portion of the first movable contact 23 to come into contact with the first fixed contact 201, which turns the switch 53 on. When the push-down of the pushed portion 161 of the movable contact body 3 is stopped, the top portions of the first to third movable contacts 23-25 move upward, causing the top portion of the first movable contact 23 to be separated from the first fixed contact 201, which turns the switch 53 off.

The first fixed contact 201 and the second fixed contact 202 are formed so that their height is equal to or smaller than the thickness of the gluing sheet 11. For example, if the thickness of the gluing sheet 11 is 50 μm, the height of the first fixed contact 201 and the second fixed contact 202 is set at 50 μm, which is equal to the thickness of the gluing sheet 11. The first fixed contact 201 and the second fixed contact 202 are formed by one-step etching. The feature that the height of the second fixed contact 202 is equal to the thickness of the gluing sheet 11 causes the back surface of the holding sheet 32 to be in contact with the surface of the second fixed contact 202, which is in contact with the gluing sheet 11, causing the holding sheet 32 and the second fixed contact 202 to be electrically connected. In response to the pushed portion 161 of the movable contact body 3 being pushed down, the holding sheet 32 is pushed down through the first to third movable contacts 23-25, causing the second fixed contact 202 and the holding sheet 32 to be electrically connected.

(Steps for Manufacturing the Movable Contact Body According to the Fifth Embodiment)

Steps for manufacturing the movable contact body 3 differ from those for the movable contact body 2 in that a holding sheet member having holes each corresponding to the contact through-hole 120 is affixed to the surface of the gluing sheet member 152, instead of the holding sheet member 153.

Since the other steps are the same as those for the movable contact body 2, detailed description thereof is omitted herein.

(Operational Advantages of the Movable Contact Body and the Switch According to the Fifth Embodiment)

In the switch 53, since the height of the first fixed contact 201 and the second fixed contact 202 is equal to the thickness of the gluing sheet 11, the first to third movable contacts 23-25 held by the holding sheet 32 bonded to the gluing sheet 11 are placed higher than the first fixed contact 201. Since the first to third movable contacts 23-25 are placed higher than the first fixed contact 201, when the switch 53 is pushed down, the top portions of the first to third movable contacts 23-25 move below the plane on which the first to third movable contacts 23-25 are placed. In general, the life of a leaf spring member for a movable contact can be extended if, when being inverted, its top portion moves below the plane on which the leaf spring is placed. The feature of the switch 53 that the height of the first fixed contact 201 and the second fixed contact 202 is equal to the thickness of the gluing sheet 11 allows for easily extending the life of the first to third movable contacts 23-25 at low cost.

(Modified Examples of the Movable Contact Bodies and the Switches According to the Embodiments)

Although the movable contact bodies 1-1, 1-2, 1-3.2 and 3 each include a leaf spring member having a shape formed by performing D-cutting and four-corner chamfering on a convex dome shape, as the movable contact, the shape of the movable contact according to the embodiments does not limited to such a shape.

Figure 21:
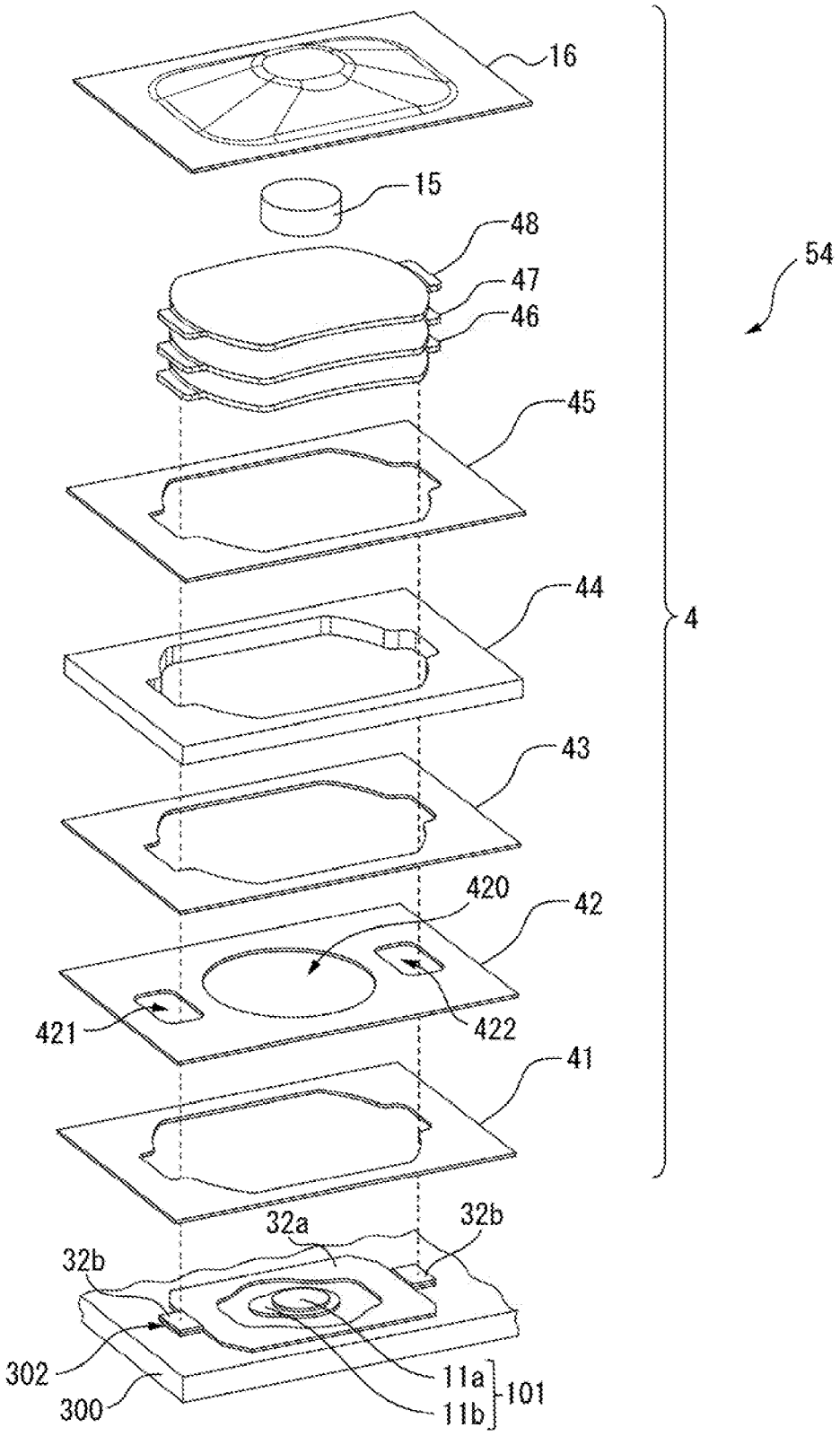
FIG. 21 is an exploded perspective view of a switch including a movable contact body for a switch of a first modified example.
Figure 22:
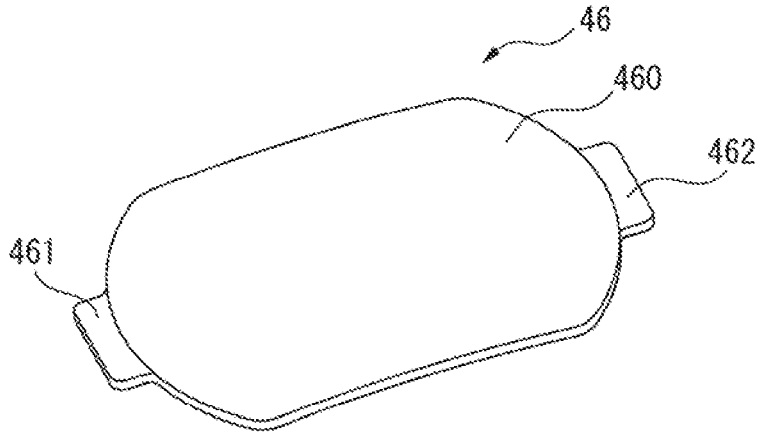
FIG. 22(*a*) is a perspective view of the first movable contact shown in FIG. 21.
Figure 22:
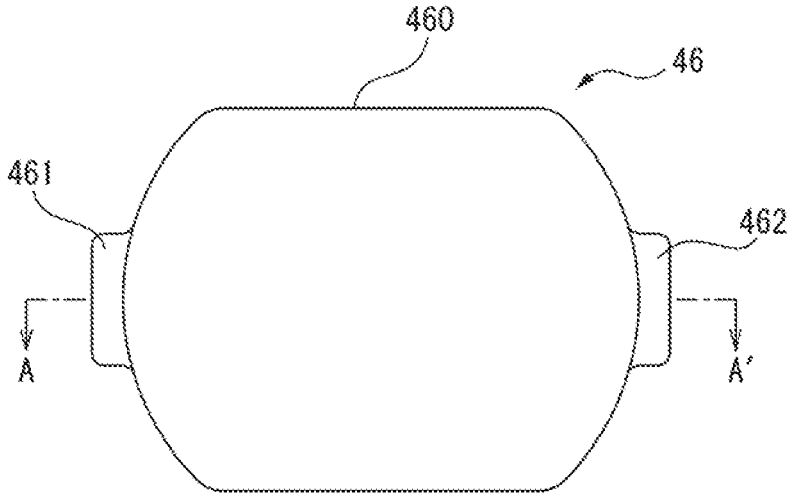
Figure 22:
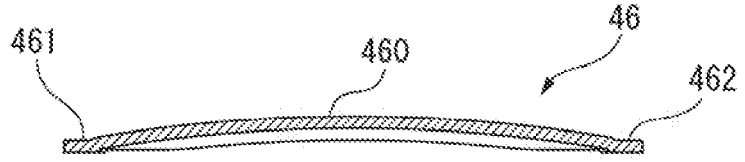

FIG. 21 is an exploded perspective view of a switch including a movable contact body for a switch of a first modified example. FIG. 22(*a*) is a perspective view of the first movable contact shown in FIG. 21; FIG. 22(*b*) is a plan view of the first movable contact shown in FIG. 21; FIG. 22(*c*) is a cross-sectional view of the first movable contact shown in FIG. 22(*b*), taken along line A-A'.

The movable contact body 4 for a switch includes a separator 10, a gluing sheet 41, a holding sheet 42, a first adhesive sheet 43, a base sheet 44, a second adhesive sheet 45, first to third movable contacts 46-48, a pusher 15 and a cover sheet 16. Since the separator 10, the pusher 15 and the cover sheet 16 have already been described with reference to FIGS. 1 to 3, for example, detailed description thereof is omitted herein. Since the gluing sheet 41, the first adhesive sheet 43, the base sheet 44 and the second adhesive sheet 45 are the same as the gluing sheet 11, the first adhesive sheet 21, the base sheet 20 and the second adhesive sheet 22, except that their frames have different shapes, detailed description thereof is omitted herein.

The holding sheet 42 has a contact through-hole 420 including at least a portion through which a top portion of the first movable contact 46 can pass, and a first through-hole 421 and a second through-hole 422. The first through-hole 421 and the second through-hole 422 are formed so that a first end portion 461 and a second end portion 462 of the first movable contact 46 can be inserted thereinto, respectively. The first through-hole 421 and the second through-hole 422 are formed so that at least regions into which the first end portion 461 and the second end portion 462 can be inserted are placed inside the frame of the gluing sheet 41.

The first movable contact 46 includes a body 460, a first end portion 461 and a second end portion 462. The first end portion 461 extends from one of the short sides of the body 460, while the second end portion 462 extends from the other short side of the body 460. Since the first movable contact 46 is the same as the movable contact 14, except for the shape, detailed description thereof is omitted herein. Since the structure and function of the second movable contact 47 and the third movable contact 48 are the same as those of the first movable contact 46, detailed description thereof is omitted herein.

The movable contact body 4 is bonded to a substrate 300 by the gluing sheet 11 with the separator 10 being peeled off, thereby constituting a switch 54. The substrate 300 has a first fixed contact 101 and a second fixed contact 302 formed thereon. Since the first fixed contact 101 has been described with reference to FIG. 2, detailed description thereof is omitted herein. The second fixed contact 302 is made of an electric conductor, such as copper, and includes a second contact base 32*a* and two second contact projections 32*b* projecting from the second contact base 32*a*. Each of the second contact projections 32*b* are in contact with either the first end portion 461 or the second end portion 462. In response to the pushed portion of the movable contact body 4 being pushed down, the top portions of the first to third movable contacts 46-48 move downward, causing the top portion of the first movable contact 46 to come into contact with the first contact projection 11*a*, which turns the switch 54 on. When the push-down of the pushed portion of the movable contact body 4 is stopped, the top portions of the first to third movable contacts 46-48 move upward, causing the top portion of the first movable contact 46 to be separated from the first contact projection 11*a*, which turns the switch 54 off.

Although the movable contact bodies 1-1, 1-2, 1-3.2, 3 and 4 each include a pusher 15, the movable contact according to the embodiments need not include the pusher 15. Although the movable contact bodies 1-1, 1-2, 1-3.2, 3 and 4 each include a separator and a gluing sheet bonding the separator and the holding sheet together, the movable contact according to the embodiments need not include the separator nor the gluing sheet.

The first contact projection 11*a* and the second contact projections have the same height on the substrate 100; however, in the switches according to the embodiments, the height of the first contact projection, which is brought into contact with the pushed movable contact, may be smaller than that of the second contact projections.

Although the holding sheet 12 in each of the movable contact bodies 1-1, 1-2, 1-3, 2, 3 and 4 is a single member, the holding member of the movable contact bodies according to the embodiments may be composed of multiple members. The holding member may include a first holding member and a second holding member which have the contact through-hole.

Figure 23:
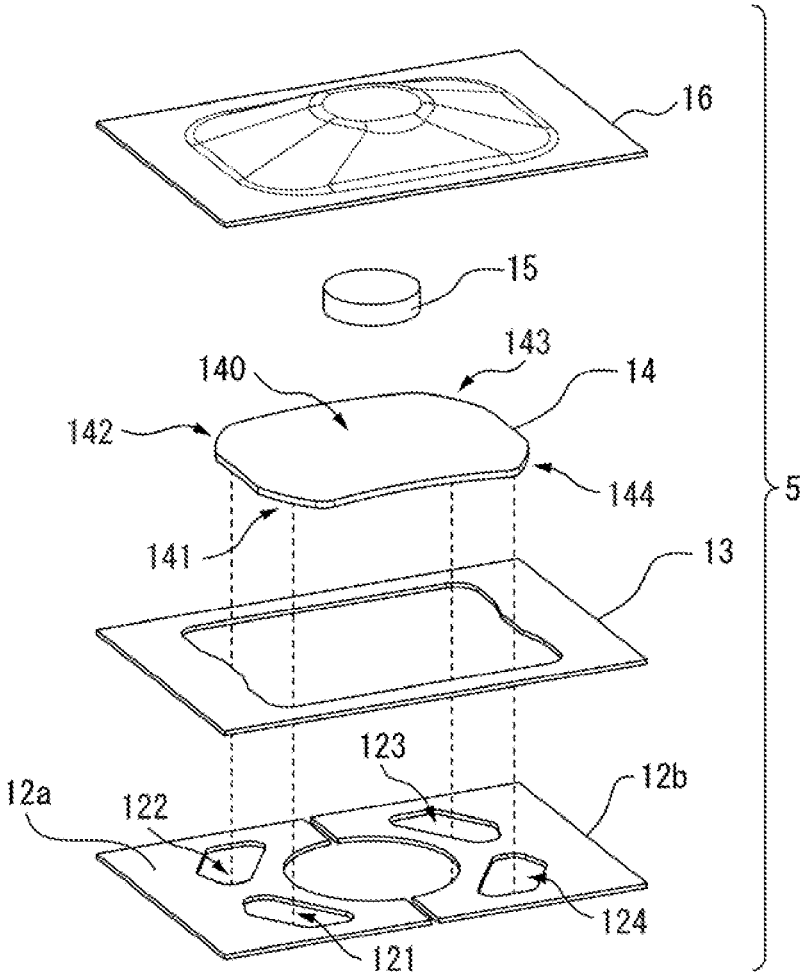
FIG. 23 is an exploded perspective view of a switch including a movable contact body for a switch of a second modified example.

FIG. 23 is an exploded perspective view of a movable contact body for a switch of a second modified example.

The movable contact body 5 for a switch differs from the movable contact body 1-1 in that it includes a first holding member 12*a* and a second holding sheet 12*b* instead of the holding member 12. Since the structure and function of components of the movable contact body 5 are the same as those of the movable contact body 1-1 assigned the same reference numerals, except for the first holding member 12*a* and the second holding member 12*b*, detailed description thereof is omitted herein.

The first holding member 12*a* and the second holding member 12*b* are quadrate holding members made of a synthetic resin, such as polyimide, polyamide and PET, similarly to the holding sheet 12. The first holding member 12*a* has a first through-hole 121 and a second through-hole 122. The second holding member 12*b* has a third through-hole 123 and a fourth through-hole 124. Bring end faces of the first holding member 12*a* and the second holding member 12*b* into contact with each other provides a contact through-hole 120, as in the holding sheet 12.

Although the switches 51-54 are each formed on the substrate 100, which is a rigid substrate, the switch according to the embodiments may be formed on a flexible printed circuit board.

Figure 24:
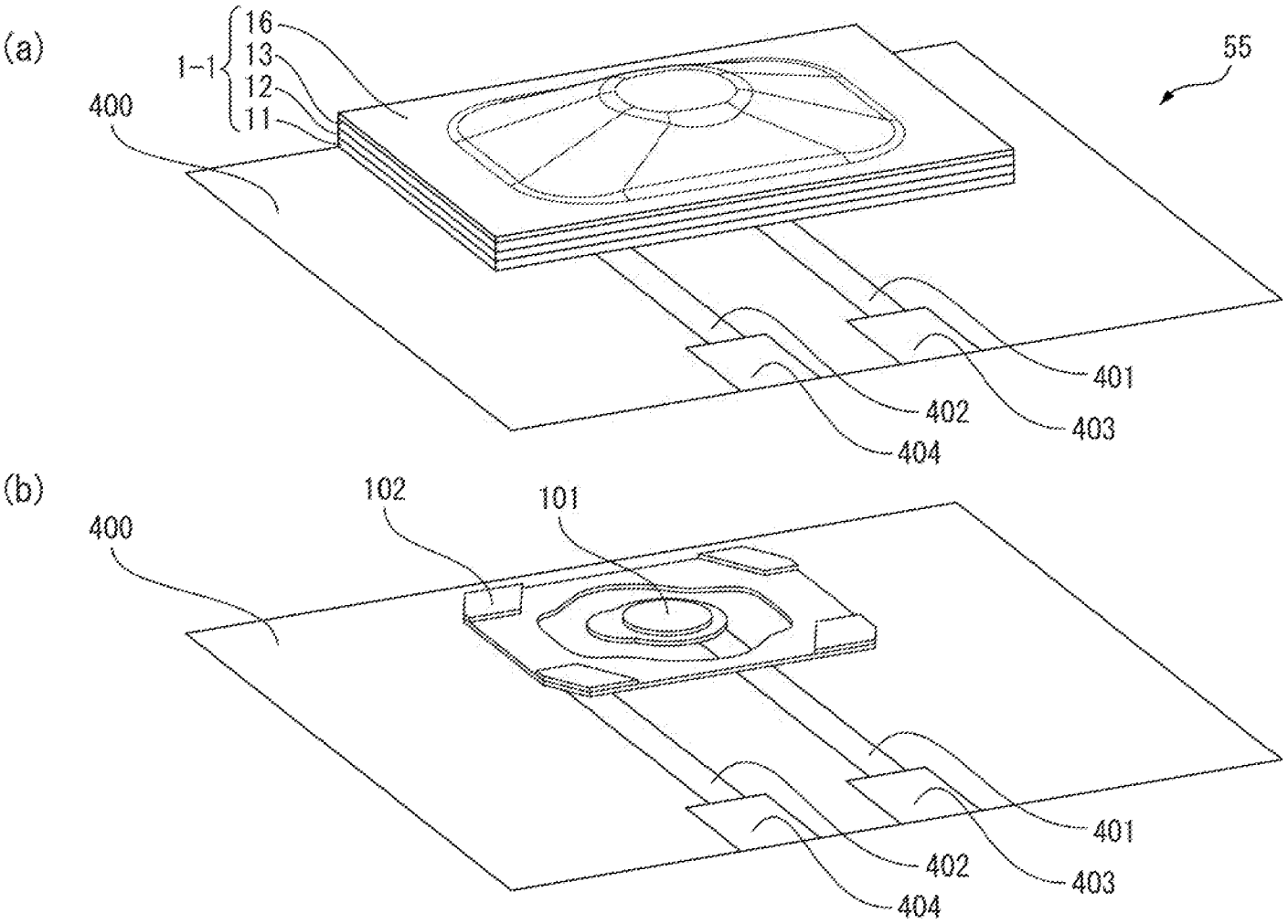
FIG. 24(*a*) is a perspective view of a switch according to a third modified example.

FIG. 24(*a*) is a perspective view of a switch according to a modified example; FIG. 24(*b*) is a perspective view of the flexible printed circuit board shown in FIG. 24(*a*).

The switch 55 includes a movable contact body 1-1, a gluing sheet 11 and a flexible printed circuit board 400. Since the movable contact body 1-1 and the gluing sheet 11 have already been described with reference to FIG. 3, for example, detailed description thereof is omitted herein.

The flexible printed circuit board 400 is a base film made of polyimide, for example, and has, on its surface, a first electrode 401, a second electrode 402, a first terminal 403 and a second terminal 404 which are made of an electrically conductive metal, such as a copper foil. The flexible printed circuit board 400 also has a first fixed contact 101 and a second fixed contact 102 formed thereon.

The first electrode 401 has one end connected to the first fixed contact 101, and the other end connected to the first terminal 403. The second electrode 402 has one end connected to the second fixed contact 102, and the other end connected to the second terminal 404.

Although the switch 55 is a single switch, the switch according to the embodiments may include multiple switches formed on a single flexible printed circuit board.

What is claimed is:

1. A movable contact body for a switch, the movable contact body comprising:

at least one movable contact having an upwardly convex leaf-spring shape;

a cover member disposed so as to cover an upper surface of the movable contact;

a frame-shaped adhesive sheet having a base layer and adhesive layers on both sides of the base layer, and arranged around an outside of the movable contact; and a holding member adhered to one of the adhesive layers, and disposed so as to face a lower surface of the movable contact, the holding member having a contact through-hole through which a top portion of the movable contact passes, wherein the frame-shaped adhesive sheet is a separate structure from that of the holding member, and the holding member is an electrically insulating member having another through-hole into which at least part of the movable contact is inserted, the through-hole being disposed around the contact through-hole.

2. The movable contact body according to claim 1, further comprising a second adhesive sheet bonded to a surface of the holding member opposite to a surface thereof facing the first adhesive sheet.

3. The movable contact body according to claim 2, further comprising a separator bonded to a surface of the second adhesive sheet opposite to a surface thereof facing the holding member.

4. The movable contact body according to claim 1, further comprising:

a second adhesive sheet bonded to a surface of the holding member opposite to a surface thereof facing the cover member; and a substrate bonded to a surface of the second adhesive sheet opposite to a surface thereof facing the holding member, wherein the substrate comprises:

a base;

first fixed contacts formed on the base; and second fixed contacts formed so as to surround the respective first fixed contacts, the movable contact body being disposed so as to be pushed down to electrically connect the first fixed contacts and the second fixed contacts.

5. The movable contact body according to claim 4, wherein the substrate is a flexible substrate.

6. The movable contact body according to claim 1, further comprising a fixing member having a hole for housing the movable contact to fix the movable contact, the fixing member being bonded to both the cover member and the holding member.

7. The movable contact body according to claim 1, wherein the holding member includes a first holding member and a second holding member which have the contact through-hole.

8. A movable contact body for a switch, the movable contact body comprising:

at least one movable contact having an upwardly convex leaf-spring shape;

a cover member disposed so as to cover an upper surface of the movable contact;

a frame-shaped adhesive sheet having a base layer and adhesive layers on both sides of the base layer, and arranged around an outside of the movable contact; and a holding member adhered to one of the adhesive layers, and disposed so as to face a lower surface of the movable contact, the holding member having a contact through-hole through which a top portion of the movable contact passes, wherein the frame-shaped adhesive sheet is a separate structure from that of the holding member, and the holding member has an electrically conductive surface, and supports a base of the movable contact on the electrically conductive surface.

9. A switch comprising:

a substrate;

a first fixed contact formed on the substrate;

a second fixed contact formed on the substrate so as to surround the first fixed contact;

a movable contact body to be pushed down to electrically connect the first fixed contact and the second fixed contact; and an adhesive member bonding the substrate and the movable contact body together, wherein the movable contact body comprises:

at least one movable contact having an upwardly convex leaf-spring shape and being in contact with the second fixed contact;

a cover member disposed so as to cover an upper surface of the movable contact; and a frame-shaped adhesive sheet having a base layer and an adhesive layers on both sides of the base layer, and arranged around an outside of the movable contact; and a holding member adhered to one of the adhesive layers, and disposed so as to face a lower surface of the movable contact, the holding member having a contact through-hole through which a top portion of the movable contact passes, wherein the frame-shaped adhesive sheet is a separate structure from that of the holding member, the holding member is an electrically insulating member having another through-hole into which at least part of the movable contact is inserted, the through-hole being disposed around the contact through-hole, and the second fixed contact includes a second contact base and a second contact projection, a difference in height between the second contact base and the second contact projection being larger than a thickness of the holding member.

10. The switch according to claim 9, wherein the holding member is an electrically conductive member at least part of which is in contact with the movable contact to electrically connect the first fixed contact and the movable contact.

11. The switch according to claim 9, wherein the substrate is a flexible substrate.

* * * * *